US006150897A

United States Patent [19]

Nishikawa et al.

[11] Patent Number: 6,150,897

[45] Date of Patent: Nov. 21, 2000

[54] BALUN CIRCUIT WITH A CANCELLATION ELEMENT IN EACH COUPLED LINE

[75] Inventors: Kenjiro Nishikawa; Ichihiko Toyoda; Tsuneo Tokumitsu, all of Tokyo, Japan

[73] Assignee: Nippon Telegraph and Telephone Corporation, Tokyo, Japan

[21] Appl. No.: 09/049,011

[22] Filed: Mar. 27, 1998

[30] Foreign Application Priority Data

Mar. 31, 1997 [JP] Japan ..... 9-098501
Jun. 18, 1997 [JP] Japan ..... 9-161390

[51] Int. Cl.[7] ..... H01P 5/10

[52] U.S. Cl. ..... 333/26; 343/859

[58] Field of Search ..... 333/26, 25; 343/859

[56] References Cited

U.S. PATENT DOCUMENTS

| | | | |
|---|---|---|---|
| 4,216,446 | 8/1980 | Iwer | 333/112 |
| 4,485,488 | 11/1984 | Houdart | 333/26 X |
| 5,025,232 | 6/1991 | Pavio | 333/26 X |
| 5,416,451 | 5/1995 | Kaltenecker et al. | 333/26 X |
| 5,497,137 | 3/1996 | Fujiki | 336/200 |
| 5,644,272 | 7/1997 | Dabrowski | 333/26 |
| 5,742,901 | 4/1998 | Nishida | 455/326 |

FOREIGN PATENT DOCUMENTS

| | | |
|---|---|---|
| 0 644 605A1 | 3/1995 | European Pat. Off. . |
| 0 769 847A1 | 4/1997 | European Pat. Off. . |
| 0 790 660 A2 | 8/1997 | European Pat. Off. . |
| 26 58 364 | 6/1978 | Germany . |
| 54-51446 | 4/1979 | Japan . |
| 56-62402 | 5/1981 | Japan . |

OTHER PUBLICATIONS

Schwindt et al, "Computer–Aided Analysis and Design of a Planar Multilayer Marchand Balun", 8099 IEEE Transactions on Microwave Theory and Techniques, vol. 42, No. 7, Part 2, Jul. 1, 1994, pp. 1429–1434.

*Primary Examiner*—Justin P. Bettendorf
*Attorney, Agent, or Firm*—Arent Fox Kinter Plotkin & Kahn PLLC

[57] ABSTRACT

A Marchand balun cirucit having a pair of coupled lines of quarter wavelength for dividing and/or combining signals with the same amplitude and opposite phase with each other is improved by inserting a cancellation element between said pair of coupled lines. Said cancellation element may be a transmission line, a capacitor, or an inductor which improves amplitude difference error and phase difference error of a pair of outputs by controlling phase velocity for an even mode so that phase velocity for an even mode becomes equal to that for an odd mode. Thus, a balun circuit with wide operation band, and less error of amplitude difference and phase difference is obtained.

5 Claims, 23 Drawing Sheets

BALUN CIRCUIT WITH A CANCELLATION ELEMENT IN EACH COUPLED LINE

BACKGROUND OF THE INVENTION

The present invention relates to a balun circuit, in particular, relates to such a circuit which is produced on an MMIC (Monolithic Micro-wave Integrated Circuit), and operates at frequency equal to or higher than 1 GHz.

A balun circuit is used for dividing and/or combining signals with the same amplitude and opposite phase with each other in a balanced frequency mixer.

A balun circuit is simple in structure as it comprises only a plurality of quarter wavelength coupled lines. The characteristic of a balun circuit depends upon characteristic impedance difference and phase velocity difference of even- and odd-modes. The larger the ratio of the characteristic impedance between even mode and odd mode is, and the smaller the phase velocity difference between even mode and odd mode is, the wider an operational frequency band of a balun circuit is.

As the phase velocity of even- and odd-modes of a coupled line differs with each other in an MMIC circuit, a prior effort to provide a wide band balun circuit has been directed to provide larger ratio of characteristic impedance between even- and odd-modes.

However, when we try to provide large ratio of characteristic impedance in a prior coupled line, size of the circuit must be large. Further, when we try to provide small phase velocity difference, the operational frequency band must be narrow.

Therefore, a balun cirucit having small size and wide operational frequency band has been desired.

FIG. 23 shows a prior balun circuit which is called a Merchand balun circuit. FIG. 23(A) shows an equivalent circuit of a balun circuit, FIG. 23(B) shows a cross section of a coupled line, and FIG. 23(C) shows an equivalent circuit of a coupled line. This structure is described in 1994 IEEE MTT-S International Microwave Symposium Digest, pp.389–391, by R. Schwindt.

In FIG. 23(B), the numeral 100 is a substrate made of GaAs which has a first surface on which a first conductor 106 and an insulation layer 102 made of $SiO_2$ are deposited, and a second surface on which a ground metal 104 is deposited. A second conductor 108 is deposited on the insulation layer 102 so that the second conductor faces with the first conductor. The length of the first conductor 106 and the second conductor 108 is quarter wavelength. The width of the first conductor 106 is for example 750 $\mu$m and the width of the second conductor 108 is for example 25 $\mu$m so that the large characteristic impedance ratio between even- and odd-modes is obtained, and the typical thicknesses of the substrate 100 and the insulation layer 102 are 125 $\mu$m and 0.75 $\mu$m, respectively.

FIG. 23(C) shows an equivalent circuit of a coupled line which has a pair of parallel lines (a) and (b), which relates to the first conductor 106 and the second conductor 108 in FIG. 23(B). When a first end of the first line (a) is called an input port which accepts an input signal, the other end of the first line (a) is a through port to which an input signal passes, a first end of the second line (b) incorporated with the input port is a coupled port, and the other end of the second line (b) is an isolation port to which an input signal is not output.

A balun cirucit has a pair of coupled lines. In FIG. 23(A), a balun circuit has a first coupled line 1 which has the ports A, B, C and D, and a second coupled line 2 which has the ports A', B', C' and D'.

The first port B of the first coupled line 1 is connected to the first port A' of the second coupled line 2, the isolation port C when the first port B is an input port is grounded, the isolation port D' of the second coupled line 2 when the first port A' is an input port is grounded, and the through port B' of the second coupled line 2 is open.

With the above structure in FIG. 23(A), when an input signal is applied to the port $P_1$ (port A) which is the through port when the first port B is an input port in the first coupled line 1, a pair of output signals of opposite phase are obtained at the ports $P_2$ and $P_3$ (port D and port C), which are a coupled port D when the port B is an input port, and a coupled port C' when the port A' of the second coupled line 2 is an input port.

FIG. 24 shows the explanatory curves of voltage standing wave V and current standing wave I along a half wavelength line between A and B' in FIG. 23(A). The current I is the maximum and the voltage V is zero at the center port B(=A') which is quarter wavelength from the input port A. The phase of the voltage V between the ports A and B(A') is opposite to that between the ports B(A') and B'. The amplitude of the voltage V is symmetrical concerning the center port B(A').

The phases at the ports D and C' which are coupled ports of the ports B and C' are opposite to each other.

Therefore, an input signal applied to the port 1 (A) is output to the output ports 2 and 3 with opposite phase and the same amplitude to each other.

FIGS. 25 and 26 show calculated characteristics of a balun circuit of FIG. 23, wherein FIG. 25 shows amplitude characteristics and FIG. 26 shows phase characteristics. A thick solid lines B, $B_1$ and $B_2$ ($B_1$ is an outut at the port 2 and $B_2$ is an output at the port 3) show the characteristics of a prior art of FIG. 23, and a thin solid line A shows an ideal characteristics. The parameters used in the calculation are as follows. The calculated results coincides well with the measured results.

(1) parameter of a coupled line of FIG. 23

Ze=121Ω characteristic impedance of even mode

Zo=21Ω characteristic impedance of odd mode $\epsilon_e$=3.02 effective dielectric constant of even mode $\epsilon_o$=4.22 effective dielectric constant of odd mode $\alpha_e$=0.15 dB/mm at 10 GHz loss of even mode $\alpha_o$=0.60 dB/mm at 10 GHz loss of odd mode (2) parameter of an ideal line (no loss line)

Ze=500Ω characteristic impedance of even mode

Zo=21Ω characteristic impedance of odd mode $\epsilon_e$=3.02 effective dielectric constant of even mode $\epsilon_o$=3.02 effective dielectric constant of odd mode It should be noted in FIGS. 25 and 26 that the prior Marchand balun circuit of FIG. 23 has the disadvantage that the amplitude and the phase deviates much in the operational frequency band, and therefore, the operational frequency band is essentially narrow. It is preferable in practice that the phase difference in an operational frequency band is within 10°, and the amplitude deviation in an operational frequency band is within 1 dB.

The reason why the operational frequency band in a prior Marchand balun circuit using a micro-strip line MMIC, a coplanar wave-guide MMIC deposited on a semiconductor substrate of GaAs and Si, or a three-dimensionalal MMIC which has dielectric multi-layers on a semiconductor substrate, together with other active circuits like an FET and other passive circuits, is narrow, is that (1) an even mode characteristic impedance of a coupled line which constitutes a balun circuit is small and it can not be large on principle, (2) even- and odd-modes have phase difference, and (3) transmission loss of a coupled line which constitutes a balun circuit is larger (larger than 0.1 dB/mm) than that of a conventional wave-guide, or a conventional coaxial cable.

FIGS. 27 and 28 show another prior balun cirucit produced on an MMIC. FIG. 27 is described in IEEE Trans. on MTT-41, No12, pp. 2330–2335, December 1993, by S. A. Maas, and FIG. 28 is described in 1995 IEEE Micro-wave and Millimeter-wave Monolithic circuits Symposium Digest, pp.155–158, by M. I. Ryu.

In FIG. 27, FIG. 27(A) is an equivalent circuit of a balun circuit, and FIG. 27(B) is cross section of a coupled line of a balun circuit of FIG. 27(A). In FIG. 27(B), a coupled line is in interdigital type having a substrate 100 made of GaAs on which a ground conductor 98 and a plurality of coupling lines 99 are deposited. The thickness of the substrate 100 is for instance 635 $\mu$m.

A coupled line 130, 140 of FIG. 27 has three fingers, and a coupled line 7, 8 of FIG. 28 has seven fingers.

The structure of FIGS. 27 and 28 has the advantage that the even mode characteristic impedance is large, and the phase velocity difference between even- and odd-modes is small, thus, an excellent balun is obtained.

However, the structure of FIGS. 27 and 28 has the disadvantage that the width of the circuit is large because of many fingers, and the thickness of the substrate is large, thus, the size of a circuit can not be small. Further, the operational frequency band of FIGS. 27 and 28 is smaller than that of FIG. 23.

SUMMARY OF THE INVENTION

An object of the present invention is to overcome the disadvantages and limitations of a prior balun circuit by providing a new and improved balun circuit.

It is also an object of the present invention to provide a balun circuit which has improved output amplitude and phase characteristics for wide frequency band.

It is also an object of the present invention to provide a balun circuit which is small in size.

It is also an object of the present invention to provide a balanced frequency mixer which uses a balun cirucit.

The above and other objects are attained by a balun circuit having an input port and a pair of output ports which provide output signals having the same amplitude and opposite phase to each other relating to input signal to said input port, comprising; a first coupled line and a second coupled line each equal to or shorter than a quarter wavelength, and each having an input port, a through port, a coupled port and an isolation port, each defined in accordance with a reference port; a reference port (B) of the first coupled line and a reference port (A') of the second coupled line being coupled; an isolation port (C) of the first coupled line being grounded, and an isolation port (D') of the second coupled line being grounded; a through port (B') of the second coupled line being open; a through port (A) of the first coupled line being an input port ($P_1$) of the balun circuit; coupling ports (D, C') of the first and the second coupled lines respectively being output ports ($P_2$, $P_3$) of the balun circuit; a cancellation element (3) being coupled with said coupled lines for compensating amplitude difference and phase difference error of output signals on said output ports ($P_2$, $P_3$).

BRIEF DESCRIPTION OF THE DRAWINGS

The foregoing and other objects, features, and attendant advantages of the present invention will be appreciated as the same become understood by means of the following description and the drawings wherein;

FIG. 3 shows an explanatory drawings of operation principle of the present invention wherein FIG. 10 shows an explanatory drawing of operation principle of a balun circuit which has a capacitor at a junction of coupled lines in the present invention, wherein FIG. 16 is an explanatory drawing of operation principle of FIG. 15, wherein FIG. 20 is an explanatory drawing of operation principle of a balun circuit of FIG. 19, wherein

DESCRIPTION OF THE PREFERRED EMBODIMENTS

Figure 23A:
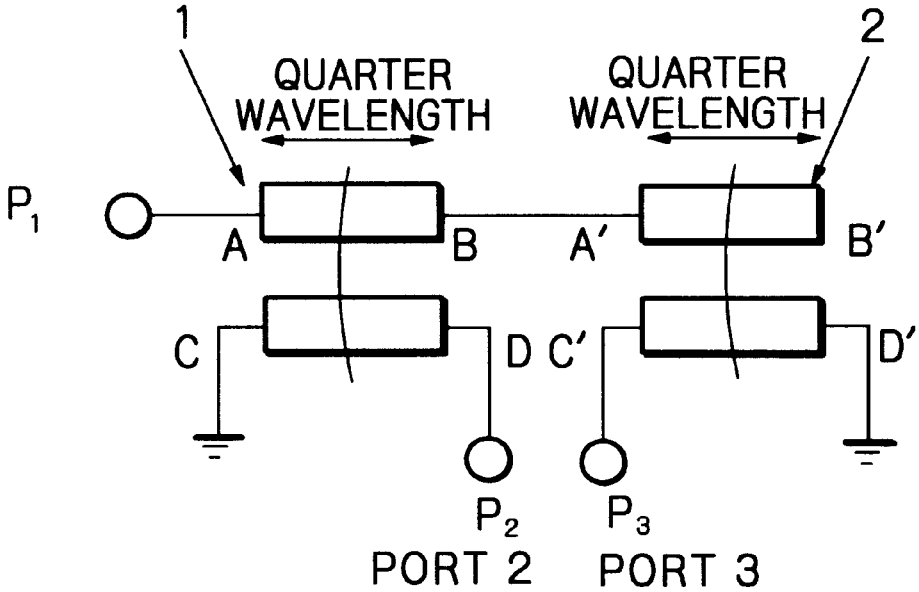
Fig. 23(A) PRIOR ART
FIG. 23(A) shows a prior balun circuit.
Figure 23B:
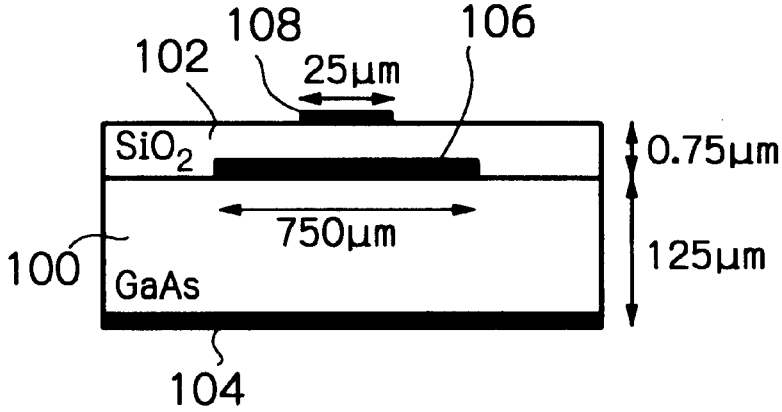
Fig. 23(B) PRIOR ART
FIG. 23(B) shows a cross section of a coupled line.
Figure 23C:
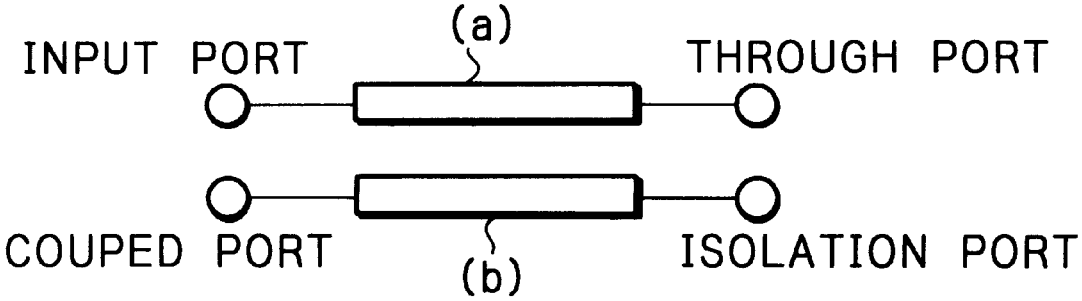
Fig. 23(C) PRIOR ART
FIG. 23(C) shows an equivalent circuit of a coupled line.
Figure 24:
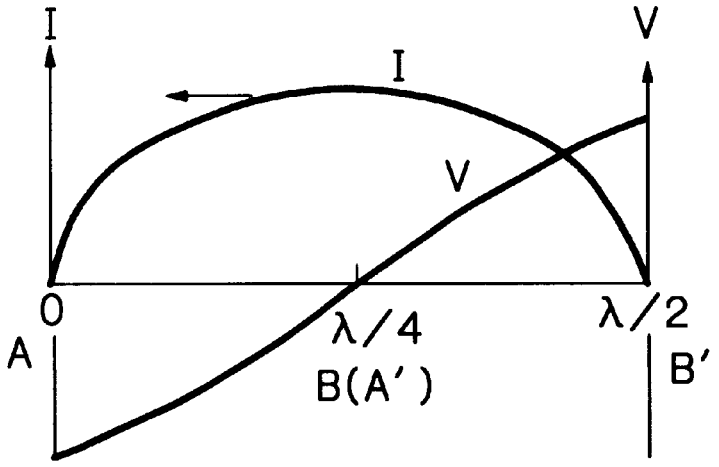
Fig. 24 PRIOR ART
FIG. 24 shows standing wave of voltage and current on a balun circuit of FIG. 23.
Figure 25:
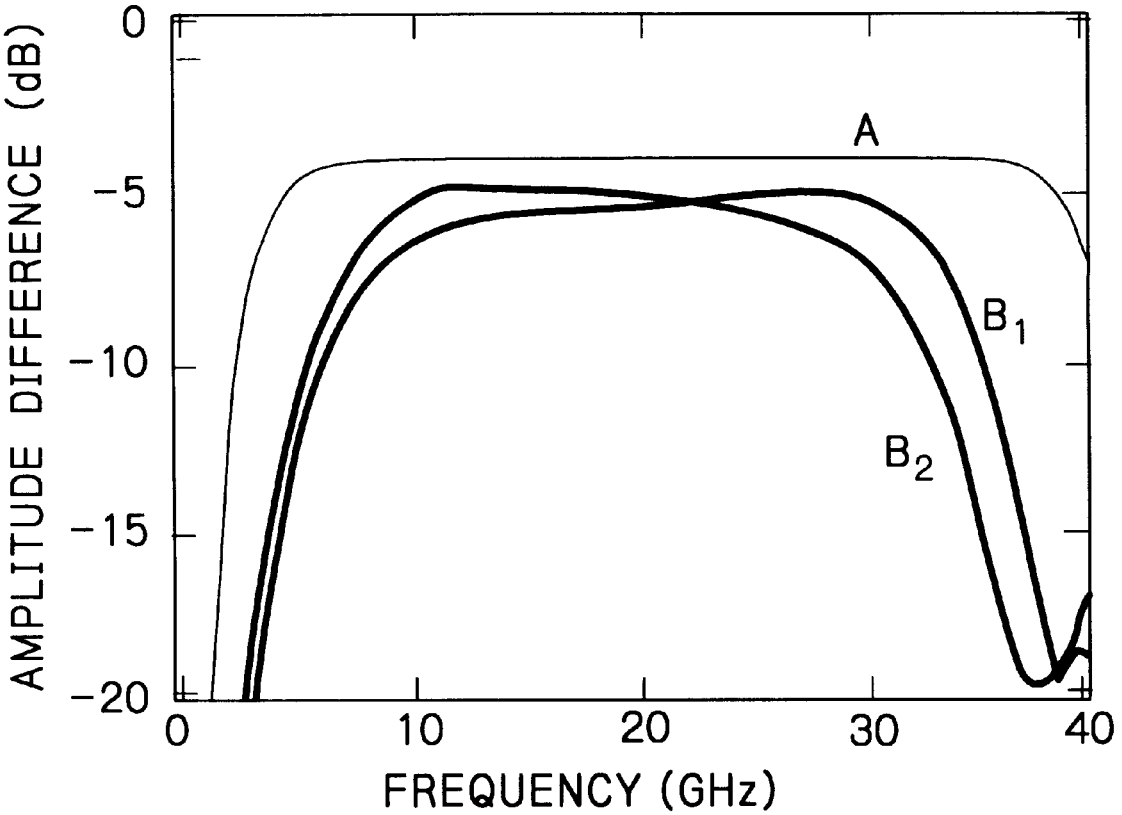
Fig. 25 PRIOR ART
FIG. 25 shows amplitude characteristics of a balun circuit of FIG. 23.
Figure 26:
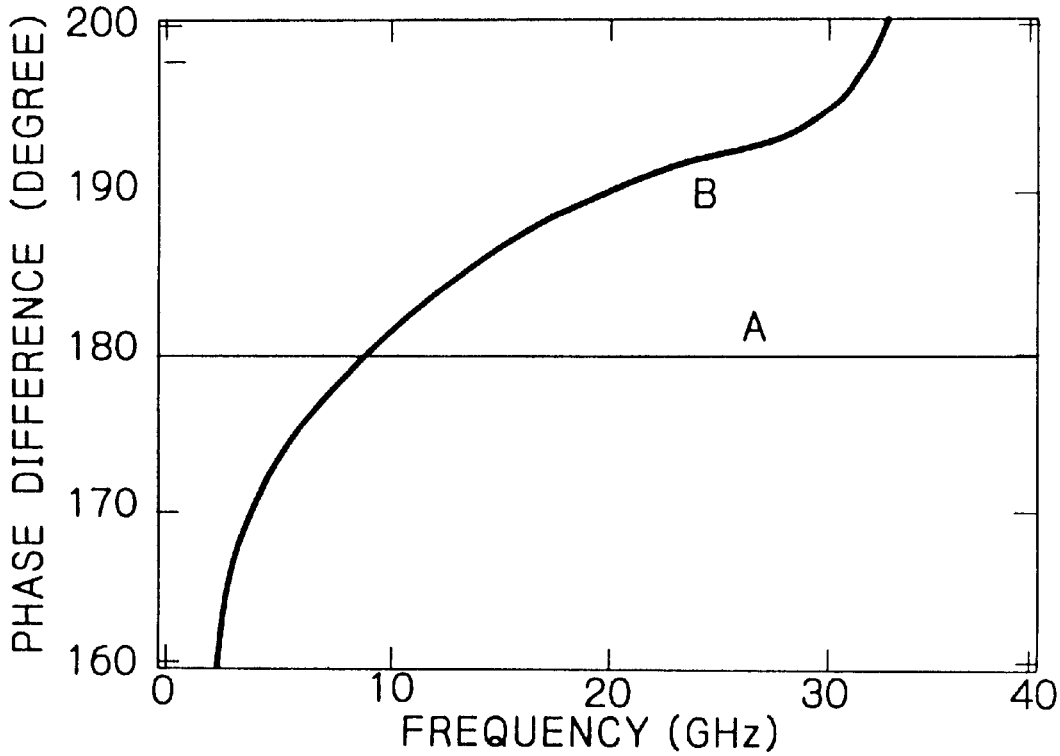
Fig. 26 PRIOR ART
FIG. 26 shows phase characteristics of a balun circuit of FIG. 23.
Figure 27A:
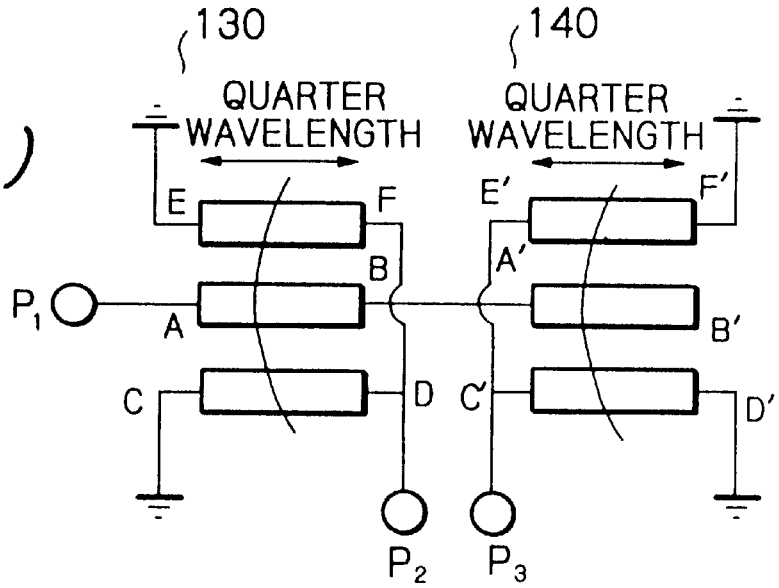
Fig. 27(A) PRIOR ART
FIG. 27(A) shows another prior balun circuit.
Figure 27B:
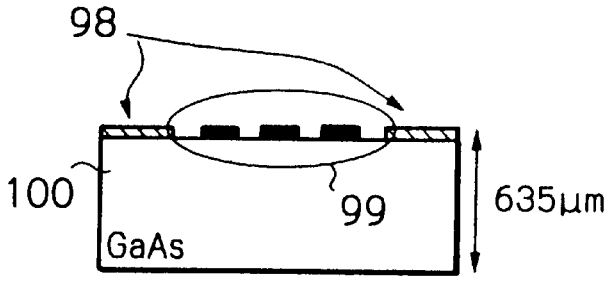
Fig. 27(B) PRIOR ART
FIG. 27(B) shows a cross section of coupled line of the balun circuit shown in FIG. 27(A)
Figure 28:
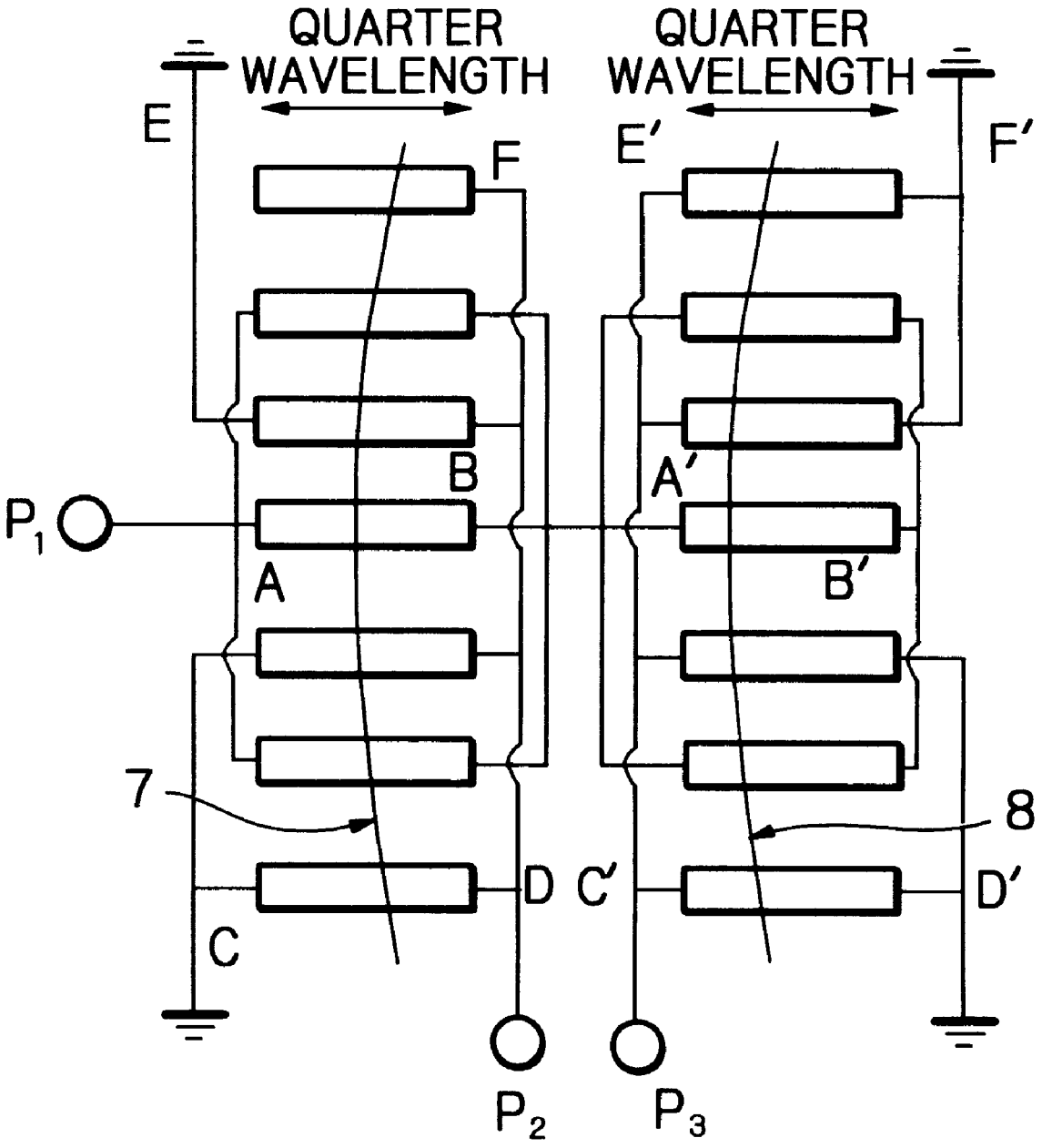
Fig. 28 PRIOR ART
FIG. 28 shows still another prior balun circuit.

A balun circuit has a pair of coupled lines which are connected in series. Each coupled line has inevitably undesired amplitude error and phase difference error in operation frequency band. A prior balun circuit of FIGS. 23, 27 and 28 intends to reduce said amplitude error and said phase difference error.

On the other hand, the basic idea of the present invention is to provide a balun circuit which has a cancellation element which has opposite amplitude difference and opposite phase difference error so that the amplitude difference and the phase difference error of a coupled line are cancelled.

The amplitude error and the phase difference error in a balun circuit are generated when each of coupled lines with a quarter wavelength has phase velocity difference between even- and odd-modes. The phase velocity of an even mode and an odd mode depends upon the capacitance for every unit length of the mode, and said capacitance depends upon which type of MMIC circuit is used as a coupled line. Therefore, the phase velocity of an even mode and an odd mode depends upon an MMIC circuit.

Accordingly, the present invention cancels or compensates an amplitude error and phase difference error by attaching a transmission line or a capacitor which reduces the phase velocity of an even mode, to a coupled line when phase velocity of an even mode in a coupled line is larger than that of an odd mode. On the other hand, when the phase velocity of an even mode of a coupled line is smaller than that of an odd mode, a transmission line or an inductor which increases the phase velocity of an even mode is attached to a coupled line.

A cancellation element which may be a transmission line, a capacitor, or an inductor compensates the amplitude error and phase difference error of an output signal of a balun circuit in wide operation frequency band. Further, as a cancellation element is simple and small in structure, a balun circuit itself may be small in size.

(First Embodiment)

Figure 1:
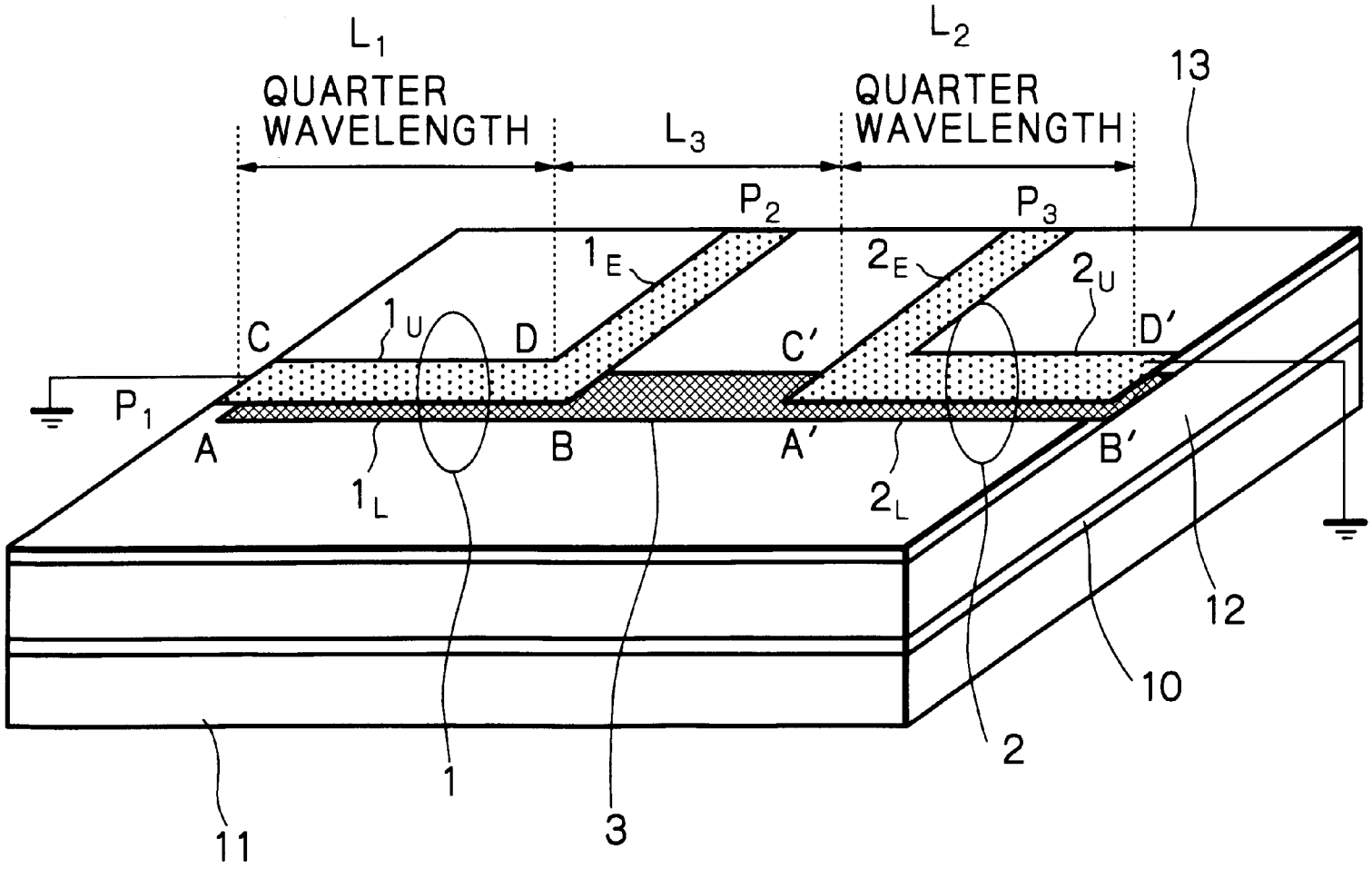
FIG. 1 is an enlarged perspective view of a balun circuit according to the present invention.
Figure 2:
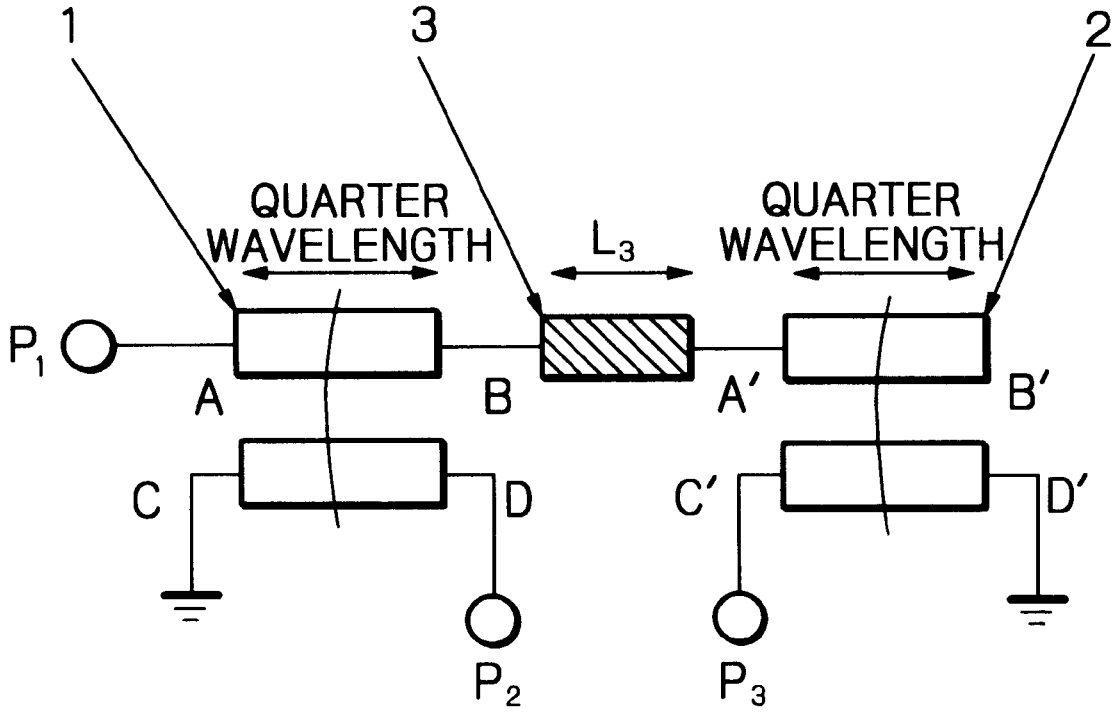
FIG. 2 is an equivalent circuit of the balun circuit of FIG. 1.

FIG. 1 shows an enlarged perspective view of a balun circuit according to the present invention, and FIG. 2 is an equivalent circuit of a balun circuit of FIG. 1. The structure of FIG. 1 belongs to three-dimensional MMIC. The symbols (port $P_1$, port $P_2$, port $P_3$, A–D, and A'–D') corresponds to those in FIG. 23.

In FIGS. 1 and 2, the numeral 11 is a semiconductor substrate made of for instance GaAs, on which a ground conductor 10 is attached on the whole area of the substrate 11. A first dielectric layer 12 made of polyimide is attached on the whole area of the ground conductor 10. On the first dielectric layer 12, a linear lower conductor $\mathbf{1}_L$ of a first coupled line 1, a first transmission line 3 and a linear lower conductor $\mathbf{2}_L$ of a second coupled line 2 are attached.

A second dielectric layer 13 made of polyimide is attached on the whole surface of the first dielectric layer 12, therefore, said conductors $\mathbf{1}_L$, 3 and $\mathbf{2}_L$ are sandwiched by the dielectric layers 12 and 13. On the second dielectric layer 13, a linear upper conductor $\mathbf{1}_U$ of the first coupled line 1 and a linear upper conductor $\mathbf{2}_U$ of the second coupled line 2 are deposited so that those conductors $\mathbf{1}_L$ and $\mathbf{2}_L$ face with the related lower conductors $\mathbf{1}_L$ and $\mathbf{2}_L$, respectively, through the second dielectric layer 13. Further, lead lines $\mathbf{1}_E$ and $\mathbf{2}_E$ are coupled with the upper conductors $\mathbf{1}_U$ and $\mathbf{2}_U$, respectively, on the second dielectric layer 13, for external connection of the balun circuit.

The thickness of the semiconductor substrate 11 is for instance 10 $\mu$m which is determined considering the request of external related circuits. The semiconductor substrate 11 itself is not necessary for the operation of a balun circuit. The thickness of the first dielectric layer 12 is for instance 7.5 $\mu$m, and the thickness of the second dielectric layer 13 is for instance 2.5 $\mu$m.

The first upper and lower conductors $\mathbf{1}_U$ and $\mathbf{1}_L$ together with the second dielectric layer 13 sandwiched between them provide the first coupled line 1 which has the length of a quarter wavelength, similarly, the second upper and lower conductors $\mathbf{2}_U$ and $\mathbf{2}_L$ together with the second dielectric layer 13 sandwiched between them provide the second coupled line 2 which has the length of a quarter wavelength. It is supposed that the length of the first transmission line 3 coupled between the first and the second coupled lines is $L_3$. A first end A of the lower conductor $\mathbf{1}_L$ of the first coupled line 1 is coupled with an input port $P_1$, and the other end B of the lower conductor $\mathbf{1}_L$ is connected to a first end of the transmission line 3. A first end B' of the lower conductor $\mathbf{2}_L$ of the second coupled line 2 is open, and the other end A' of the second lower conductor $\mathbf{2}_L$ is connected to the other end of the transmission line 3.

A first end C of the upper conductor $\mathbf{1}_U$ of the first coupled line 1 facing with said first end A of the lower conductor $\mathbf{1}_L$ is grounded, and the other end D of the upper conductor $\mathbf{1}_U$ is coupled with the first output port $P_2$ through the conductor $\mathbf{1}_E$. The first end D' of the upper conductor $\mathbf{2}_U$ of the second coupled line 2 facing with said first end B' of the lower conductor $\mathbf{2}_L$ is grounded, and the other end C' of the upper conductor $\mathbf{2}_U$ of the second coupled line 2 is coupled with the second output port $P_3$ through the conductor $\mathbf{2}_E$.

Figure 3A:
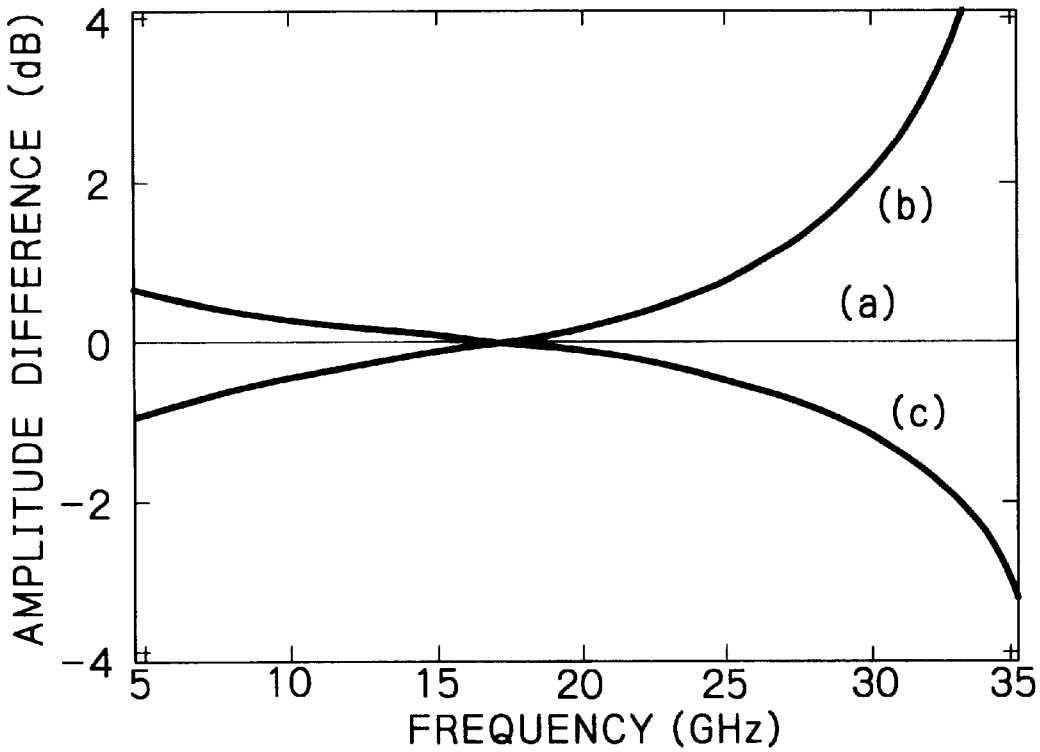
FIG. 3(A) shows amplitude characteristics.
Figure 3B:
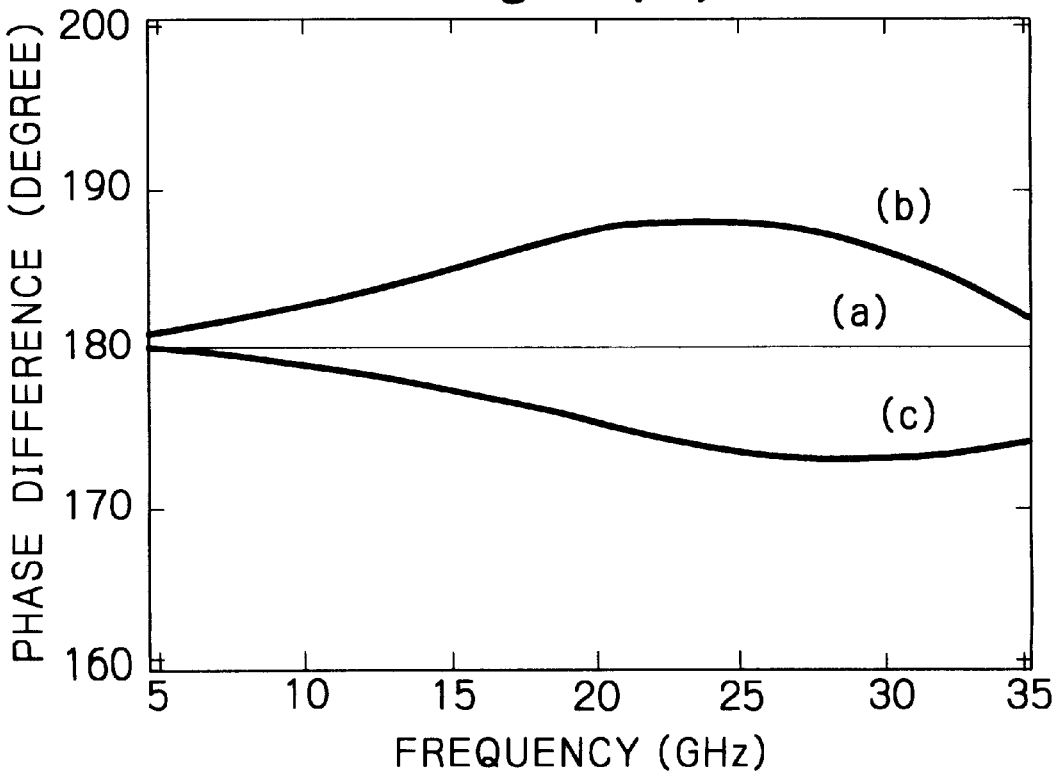
FIG. 3(B) shows phase characteristics.

FIG. 3 shows curves for explanation of operation principle of the balun circuit of FIGS. 1 and 2, in which FIG. 3(A) shows calculated amplitude characteristics of a balun circuit, and FIG. 3(B) shows calculated phase characteristics of a balun circuit. In those drawings, the curve (a) shows an ideal case when no phase velocity difference between even- and odd-modes exist in a balun circuit, the curve (b) shows a case when there exists phase velocity difference between even- and odd-modes, and the curve (c) shows a case when a transmission line 3 is inserted between the coupled lines of the ideal case of the curve (a).

The parameters in FIG. 3 are as follows.

Coupled line;

Characteristic impedance of even mode; 121Ω

Characteristic impedance of odd mode; 21Ω

Length $L_1$ of a coupled line; 1.987 mm

Transmission line 3;

Characteristic impedance; 60Ω

Effective dielectric constant; $\epsilon_{eff}$=3.3

Curve (a);

Effective dielectric constant of even mode; $\epsilon_e$=3.04

Effective dielectric constant of odd mode; $\epsilon_o$=3.04

Curve (b);

Effective dielectric constant of even mode; $\epsilon_e$=3.04

Effective dielectric constant of odd mode; $\epsilon_o$=4.22

Curve (c);

Effective dielectric constant of even mode; $\epsilon_e$=3.04

Effective dielectric constant of odd mode; $\epsilon_o$=3.04

Length $L_3$ of transmission line; $L_3$=0.28 mm

It should be appreciated in FIG. 3 that the curve (b) where there exists phase velocity difference is opposite to the curve (c) where a transmission line 3 is coupled with the balun circuit, and those curves (b) and (c) are symmetrical relating to the ideal curve (a). Therefore, the amplitude error and the phase difference error of a balun circuit is compensated by attaching a transmission line 3 between two coupled lines, although characteristic impedance of even mode and loss of a coupled line are the same as those of a prior art.

Figure 4:
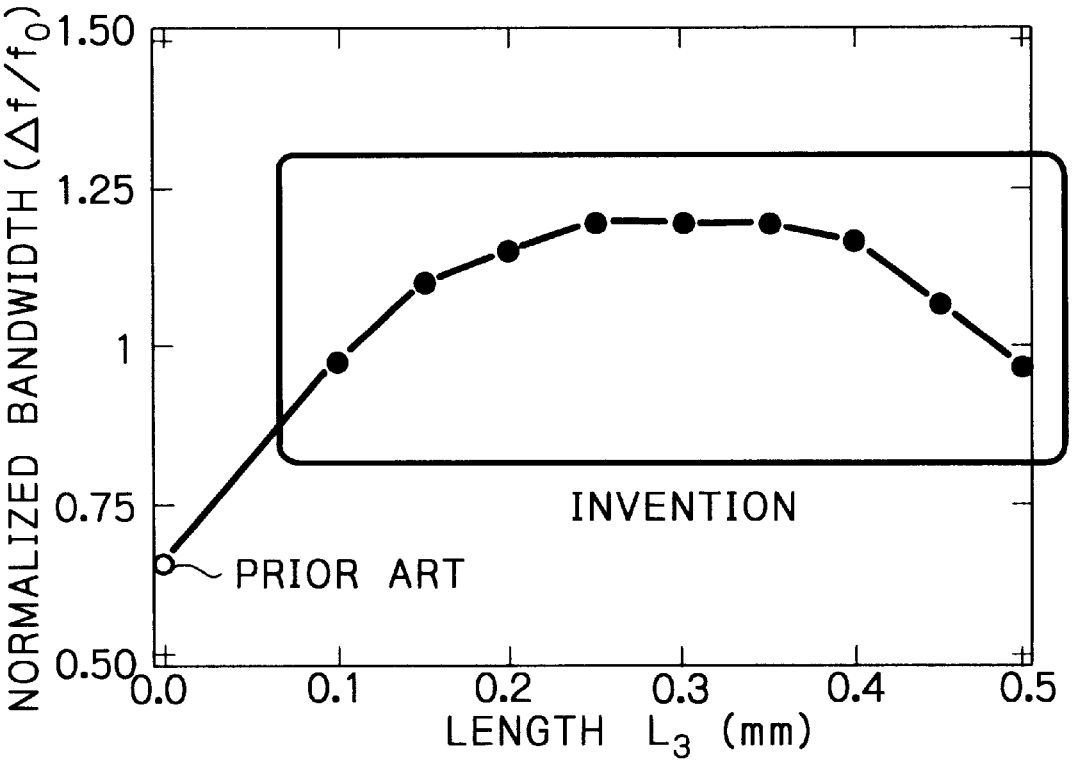
FIG. 4 shows relations between the length $L_3$ of the transmission line of the present invention and the normalized bandwidth.
Figure 5:
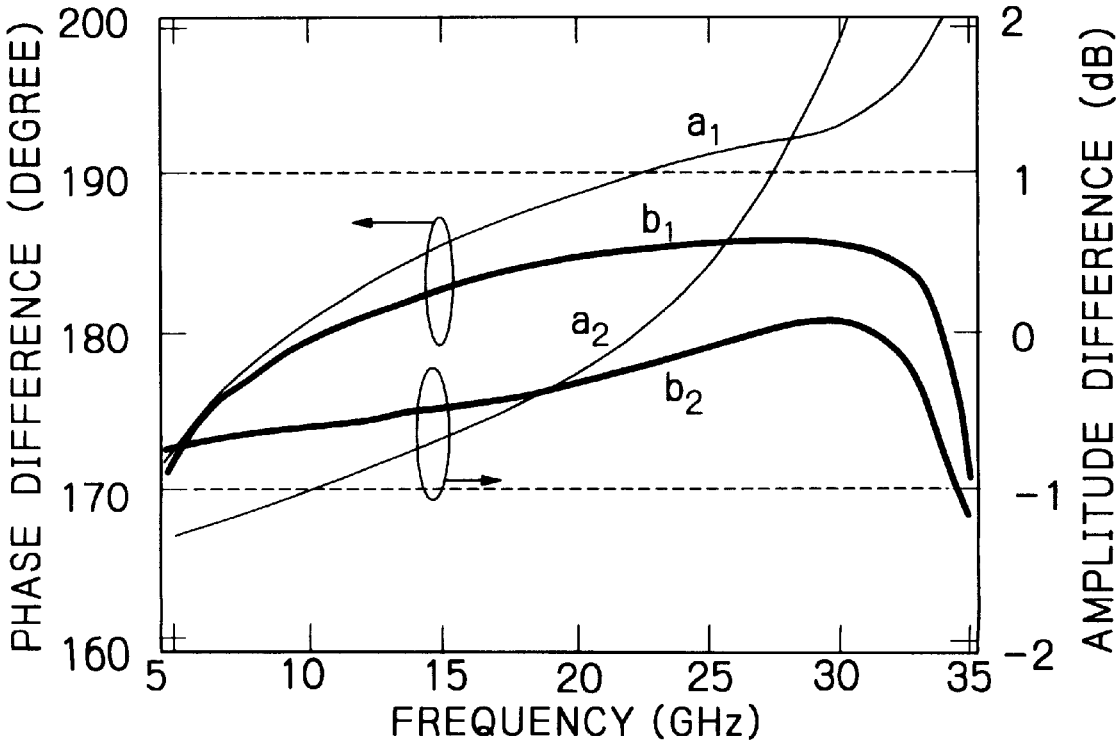
FIG. 5 shows the frequency characteristics of amplitude difference and phase difference error when the length of the transmission line of the present invention is fixed.
Figure 6:
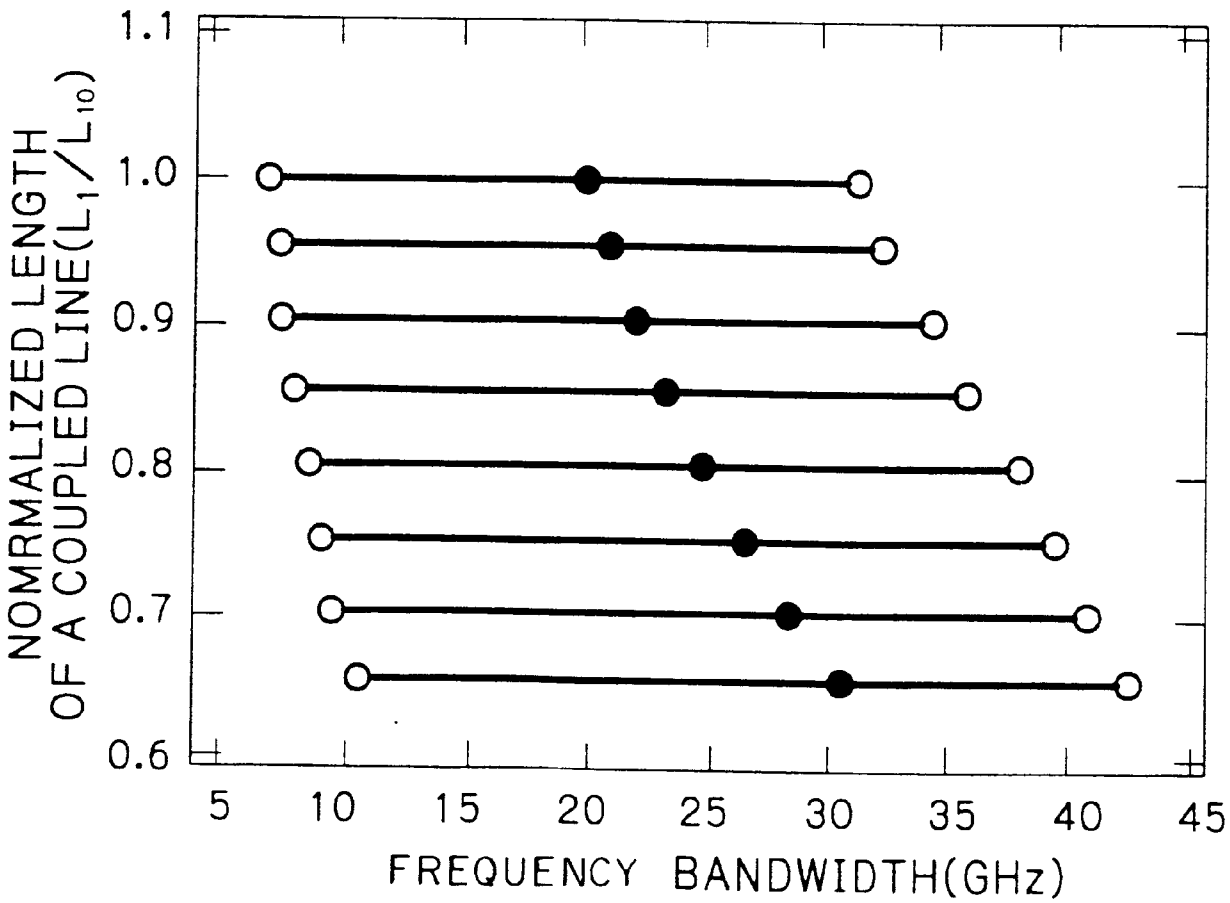
FIG. 6 shows the calculated operational bandwidth for each length of the transmission line of the present invention.

The operation of the balun circuit of FIGS. 1 and 2 is now described in accordance with FIGS. 4–6.

FIG. 4 shows a calculated curve between normalized bandwidth $\Delta f/f_0$ and the length $L_3$ of a transmission line 3 inserted between the coupled lines of quarter wavelength, where the operational center frequency of the balun is 20 GHz, the characteristic impedance and the effective dielectric constant of the transmission line 3 are $Z_0$=60Ω and $\epsilon_{eff}$=3.3, respectively. The normalized bandwidth is defined so that the phase difference error is less than 10 degrees, the amplitude difference is less than 1 dB, and 3 dB bandwidth of an output signal is assumed.

In FIG. 4, the normalized bandwidth in a prior art is around 0.65 as shown by a white dot in FIG. 4. On the other hand, the normalized bandwidth of the present invention which has a transmission line 3 is 1.8 times as large as that of a prior art as shown by the curve enclosed by the frame.

FIG. 5 shows the curves of the frequency characteristics of the phase difference error and the amplitude difference when the length $L_3$ of the transmission line is fixed ($L_3$=0.3 mm), where it is supposed that the phase velocity of even mode is higher than that of odd mode. In FIG. 5, the thin curves $a_1$ and $a_2$ show phase difference error and amplitude difference, respectively, of a prior art which has no transmission line, and the thick curves $b_1$ and $b_2$ show the phase difference error and amplitude difference, respectively, of the present invention which has a transmission line.

It should be noted in FIG. 5 that the frequency characteristics of phase difference error ($b_1$) and amplitude difference ($b_2$) becomes small and is improved as compared with those ($a_1$ and $a_2$) of a prior art. Accordingly, it should be noted that the presence of a transmission line 3 decreases the amplitude difference and phase difference error in the operation band, and thus, increases the operation bandwidth.

FIG. 6 shows the calculated operation bandwidth when the length $L_1$ of a coupled line is changed, wherein the horizontal axis shows frequency in GHz, and the vertical axis shows the normalized length ($L_1/L_{10}$) of a coupled line normalized by $L_{10}$=1.987 mm which is quarter wavelength for 20 GHz. The length $L_3$ of the transmission line is $1_3$=0.3 mm. In FIG. 6, a line terminated by white circles shows operation frequency band of a balun circuit, and a black circle shows center frequency (quarter wavelength) of a coupled line.

It should be noted in FIG. 6 that when a center frequency increases, an upper limit of operation frequency bend increases, however, a lower limit of operation frequency band increases scarcely. In other words, when the length of coupled lines is decreased so that center frequency of coupled lines sets high, the lower limit of operation band of a balun circuit changes scarcely and the upper limit of operation band of a balun circuit increases. Thus, the operation bandwidth is increased. Further, as the length of coupled lines is shortened, the size of a balun circuit is decreased.

It should be noted in FIG. 6 that a coupled line longer than 0.65×(a quarter wavelength) is enough for operation.

Wavelength is the present specification means the wavelength of a signal in a coupled line.

The above first embodiment shows a multi-layer/three-dimensional MMIC structure. Some modifications are of course possible to those skilled in the art, for instance, a micro-strip type MMIC is possible instead of a three-dimensional MMIC, and/or an offset transmission line or an offset coupled line in meander type or spiral type is possible instead of a linear type.

(Second Embodiment)

Figure 7:
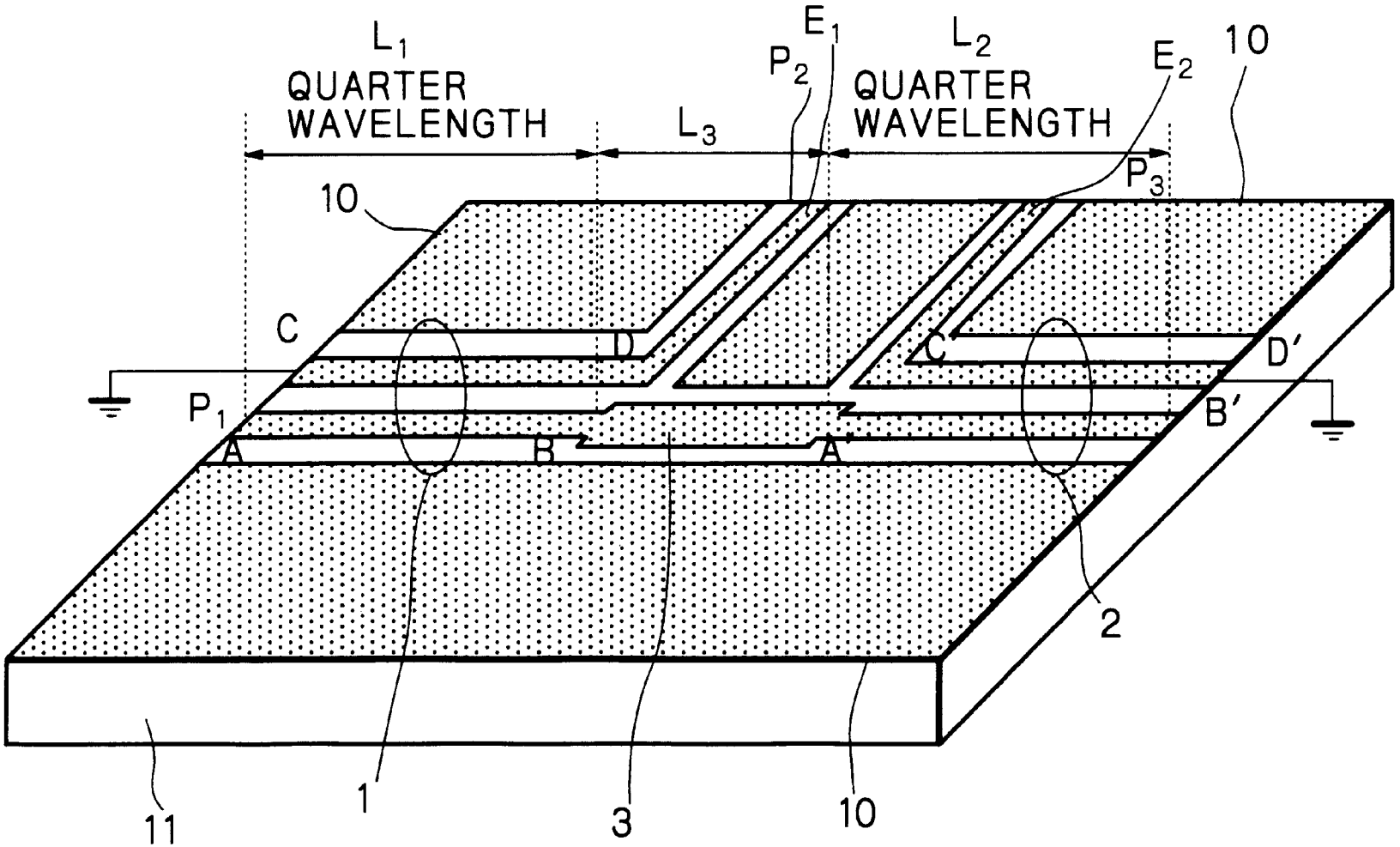
FIG. 7 shows an enlarged perspective view of another embodiment of a balun circuit according to the present invention.

FIG. 7 shows a second embodiment of a balun circuit according to the present invention. The equivalent circuit of FIG. 7 is the same as that of FIG. 2. The feature of the embodiment of FIG. 7 is that a balun circuit is composed of a coplanar circuit, instead of a three-dimensional MMIC. In FIG. 7, the symbols A–D, A'–D', ports $P_1$–$P_3$ correspond to those in FIG. 2, and those in FIG. 23.

In FIG. 7, the numeral 11 is a semiconductor substrate, on which a ground conductor 10 is attached. A pair of lines composing a first coupled line 1, another pair of lines composing a second coupled line 2, and a transmission line 3 which is inserted between one of the lines of the first and the second coupled lines are provided by slotting or removing a part of the ground conductor 10.

The structure of FIG. 7 has the similar advantage to that of the embodiment of FIG. 1, and provides the improved amplitude difference and the improved phase difference error, and thus, increases the operation bandwidth. Further, even when the length of the coupled lines is shorter than quarter wavelength and the operation center frequency is higher than the desired center frequency, no deterioration of operation frequency band of a balun circuit occurs, and therefore, the length of coupled lines may be shortened, and a small sized balun circuit is obtained.

Of course, a meander or a spiral type coupled line and/or a transmission line is possible, instead of a linear line.

(Third Embodiment)

Figure 8:
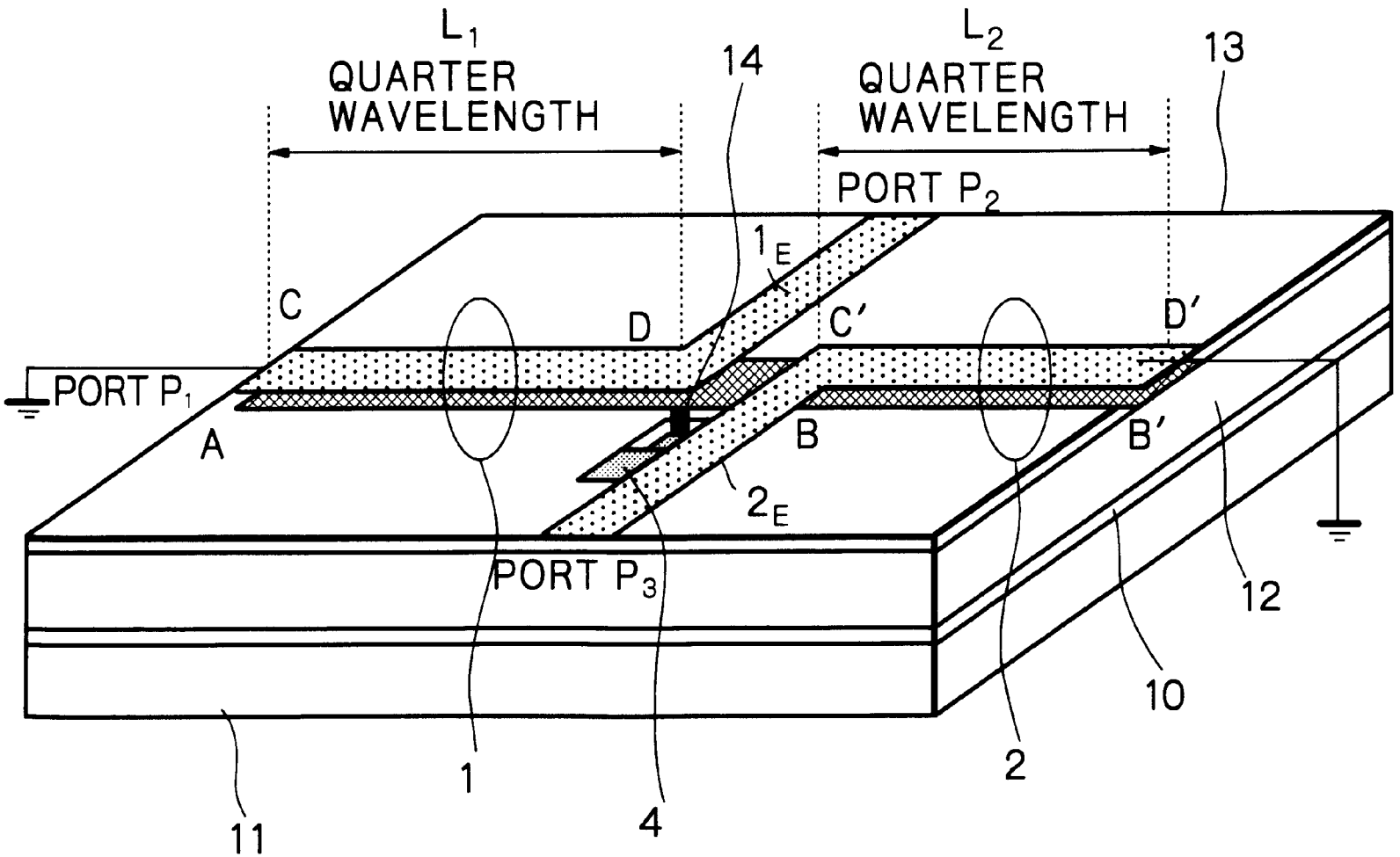
FIG. 8 shows an enlarged perspective view of still another embodiment of a balun circuit according to the present invention.
Figure 9:
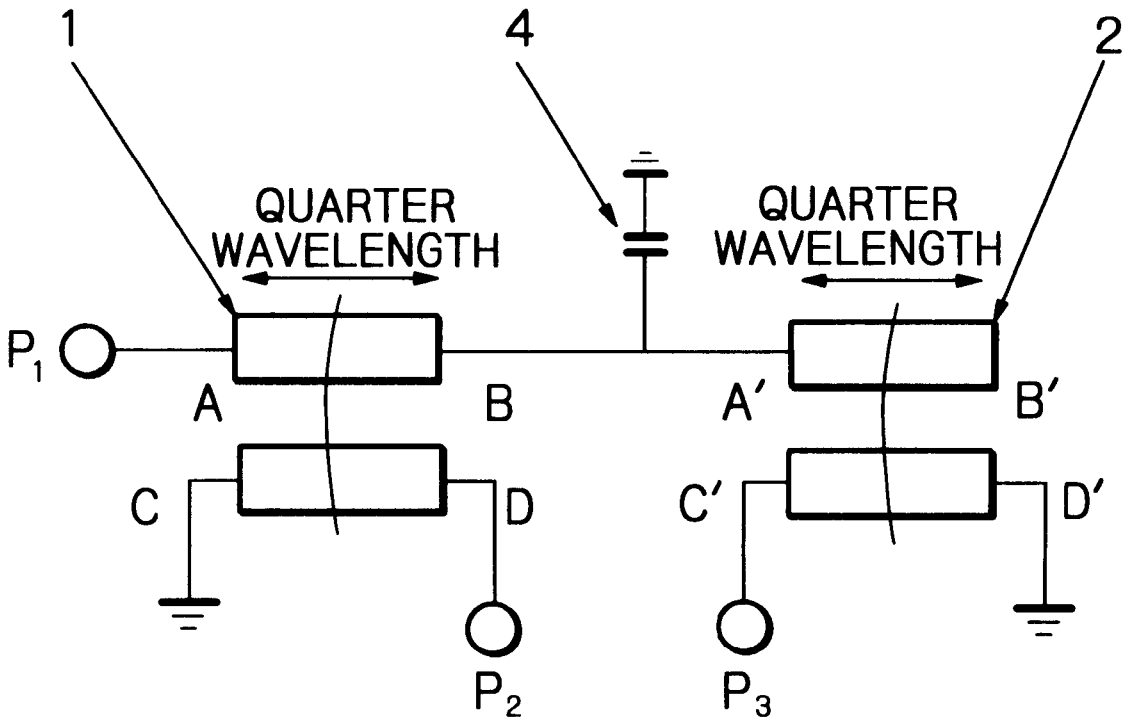
FIG. 9 is an equivalent circuit of a balun circuit of FIG. 8.

FIG. 8 shows the structure of third embodiment of a balun circuit according to the present invention, and FIG. 9 shows an equivalent circuit of the balun circuit of FIG. 8. The balun circuit of FIG. 8 is implemented by a three-dimensional MMIC. The symbols in FIGS. 8 and 9 correspond to those in FIG. 23.

In FIGS. 8 and 9, the numeral 11 is a semiconductor substrate, on which a ground conductor 10 is attached. A capacitor 4 is provided on the semiconductor substrate 11 in a window which is provided by removing a part of the ground conductor 10. One end of the capacitor 4 is connected to the ground conductor 10. A first dielectric layer 12 is attached on the ground conductor 10. On the first dielectric layer 12, a lower conductor of a first coupled line and a lower conductor of a second coupled line are produced. The length of those coupled lines is a quarter wavelength.

A second dielectric layer 13 is attached on the first dielectric layer 12 and the lower conductors of the coupled lines. An upper conductor of a first coupled line 1 and an upper conductor of a second coupled line 2 are deposited on the second dielectric layer 13 so that each upper conductor faces with a related lower conductor.

One end A of the lower conductor of the first coupled line 1 provides an input port $P_1$, and the other end of said lower conductor provides the end B. One end B' of the lower conductor of the second coupled line 2 is open, and the other end A' of said lower conductor is coupled with said end B. A conductive through hole 14 penetrates the first dielectric layer 12 so that said conductive through hole 14 connects said end B (A') of the lower conductor to one of the electrodes of the capacitor 4.

One end C of the upper conductor of the first coupled line 1 facing with said end A is grounded, and the other end D is coupled with a conductor $\mathbf{1}_E$ which is deposited on the second dielectric layer 13 having one end as a second port $P_2$ for an external connection. One end D' of an upper conductor of the second coupled line 2 facing the end B' is grounded, and the other end C' is coupled with a conductor $\mathbf{2}_E$ which is deposited on the second dielectric layer 13 having one end as a third port $P_3$.

Figure 10A:
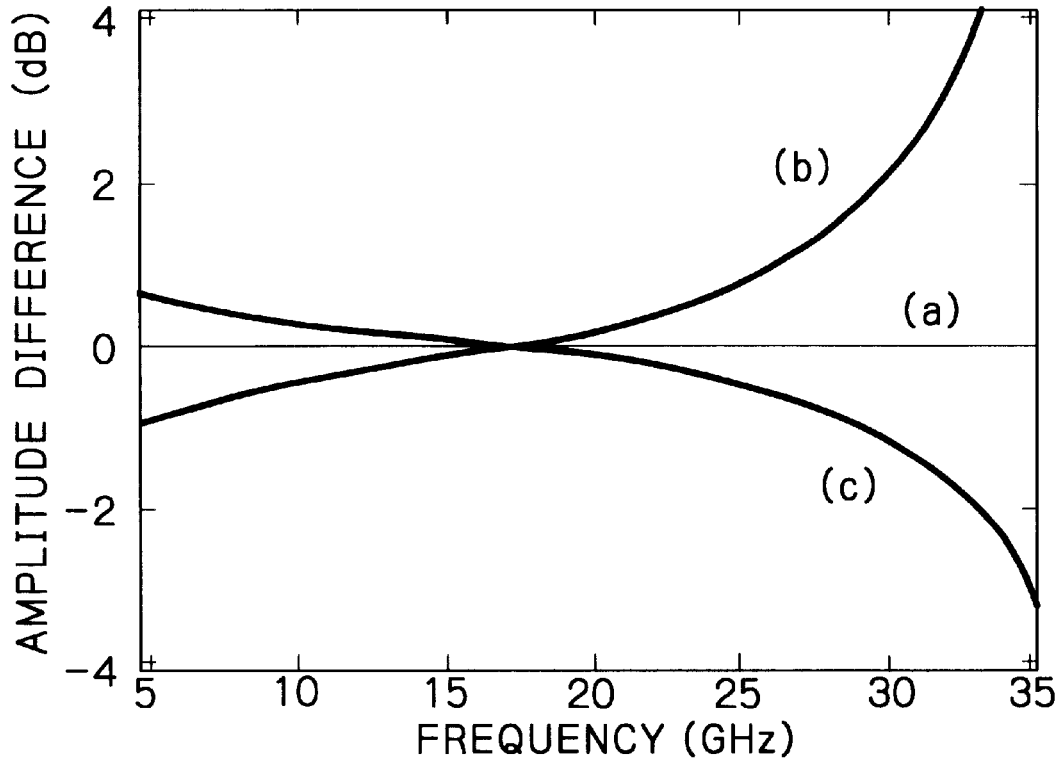
FIG. 10(A) shows calculated amplitude characteristics.
Figure 10B:
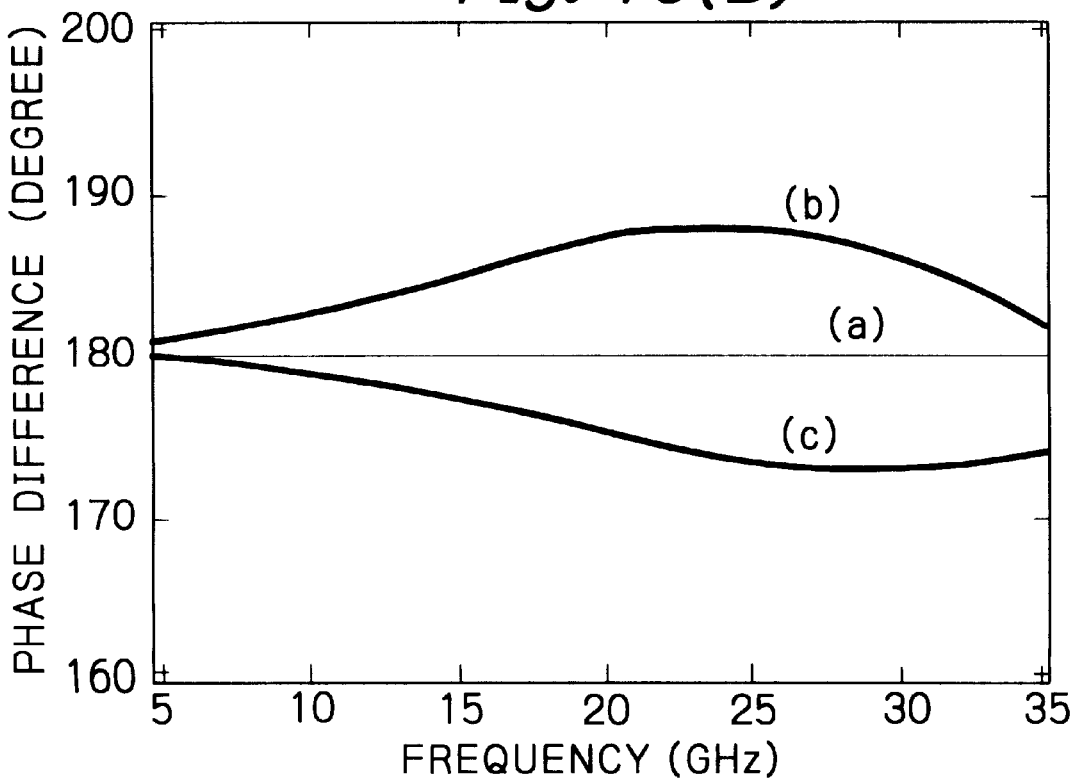
FIG. 10(B) shows calculated phase characteristics.

FIG. 10 shows curves for explanation of operation principle of the balun circuit of FIGS. 8 and 9 which has a capacitor between a coupled line and ground. FIG. 10(A) shows calculated amplitude characteristics of a coupled line, and FIG. 10(B) shows calculated phase characteristics of a coupled line. In those drawings, the curve (a) shows an ideal case when no phase velocity difference between even- and odd-modes exist in balun circuit, the curve (b) shows a case when there exists phase velocity difference between even- and odd-modes, and the curve (c) shows a case when a capacitor 4 is coupled between a junction of coupled lines and a ground conductor of an ideal balun circuit of the curve (a).

The parameters of a coupled line and a capacitor are as follows.

Coupled line;

Characteristic impedance of even mode; $Z_e$=121Ω

Characteristic impedance of odd mode; $Z_o$=21Ω

Length $L_1$ and $L_2$ of a coupled line; $L_1$=1.987 mm

Curve (a);

Effective dielectric constant of even mode; $\epsilon_e$=3.04

Effective dielectric constant of odd mode; $\epsilon_o$=3.04

Curve (b);

Effective dielectric constant of even mode; $\epsilon_e$=3.04

Effective dielectric constant of odd mode; $\epsilon_o$=4.22

Curve (c);

Effective dielectric constant of even mode; $\epsilon_e$=3.04

Effective dielectric constant of odd mode; $\epsilon_o$=3.04

Capacitance of the capacitor 4; C=0.03 pF

It should be appreciated in FIGS. 10(*a*) and 10(B) that the curve (b) where there exists phase velocity difference in a balun circuit is opposite to the curve (c) where a capacitance is provided, and those curves (b) and (c) are symmetrical relating to the ideal curve (a). Therefore, the amplitude error and the phase difference error of a balun circuit is compensated by the presence of a capacitor between a coupled line and a ground conductor, although characteristic impedance of even mode and loss of a coupled line are the same as those of a prior art.

As described above, the third embodiment which has a capacitor 4 between a junction B of lower conductors of coupled lines 1 and 2 and a ground conductor has the similar effect to that of the first embodiment, and when an input signal applied to an input port $P_1$, a pair of outputs having the same amplitude and opposite phase with each other are obtained across the outputs ports $P_2$ and $P_3$.

Figure 11:
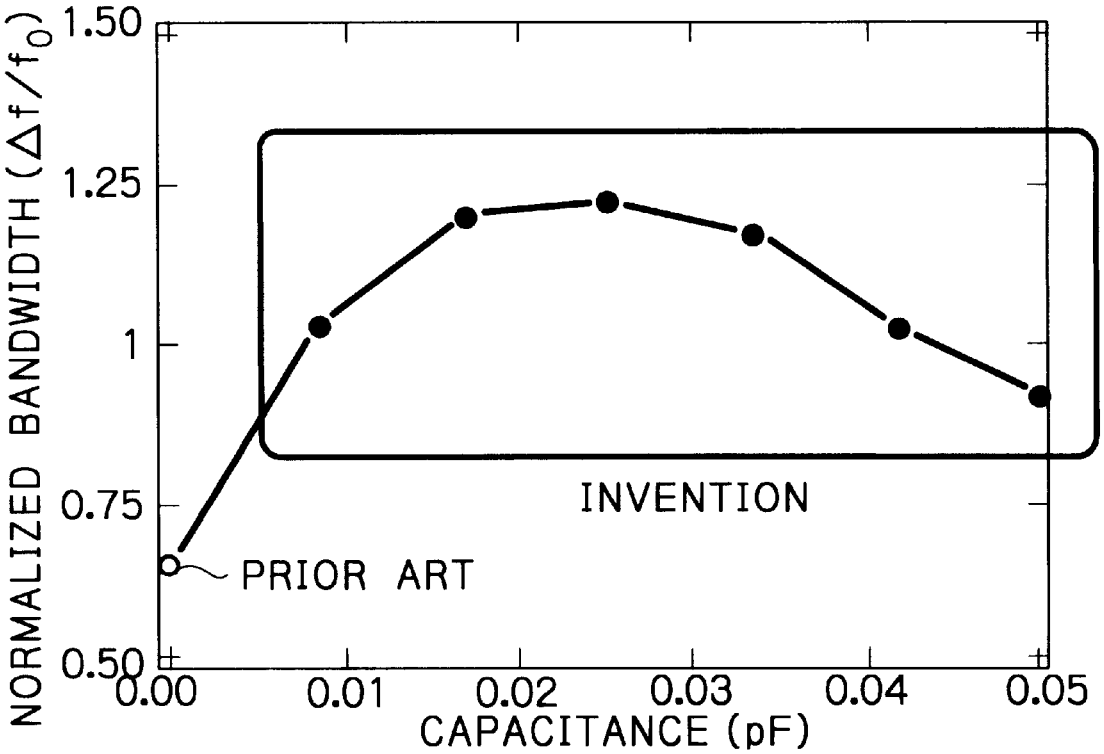
FIG. 11 shows relations between capacitance and normalized bandwidth.
Figure 12:
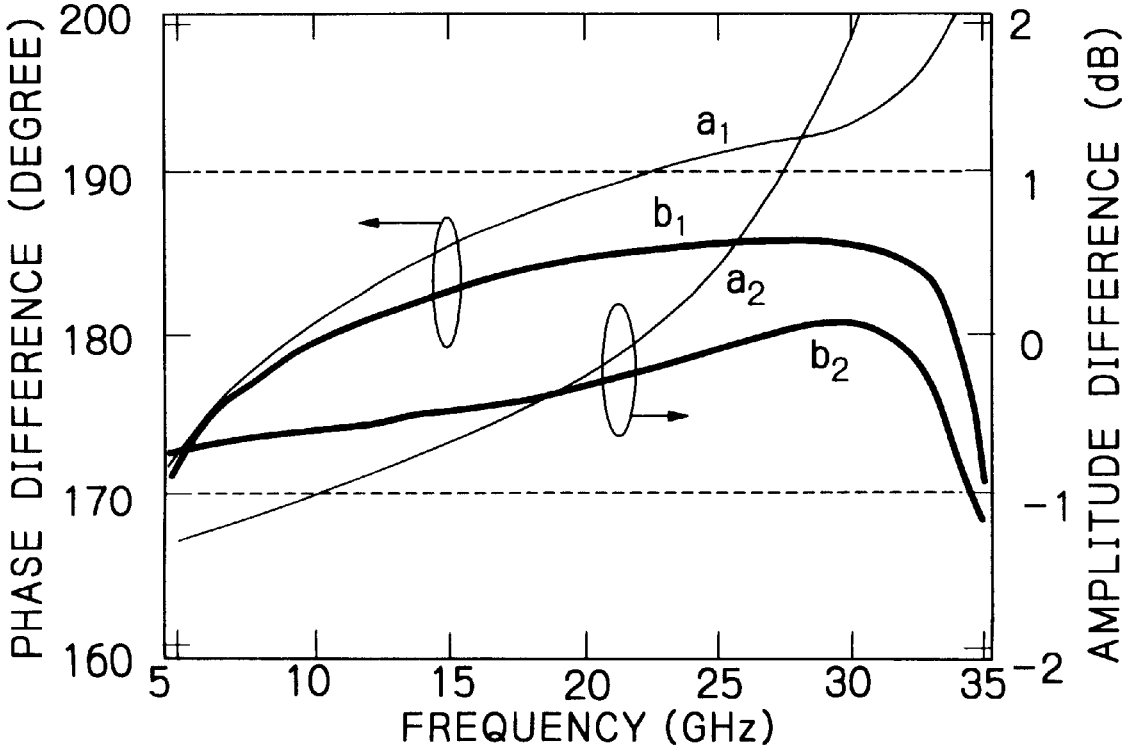
FIG. 12 shows frequency characteristics of amplitude difference and phase difference error when the capacitance is fixed.

The operation of the third embodiment is now described in accordance with FIGS. 11, and 12.

FIG. 11 shows calculated curve between normalized bandwidth $\Delta f/f_0$ and the capacitance C (pF) of the capacitor 4, where the operational center frequency of the balun is 20 GHz.

In FIG. 11, the normalized bandwidth in a prior art is around 0.65 as shown by a white dot in FIG. 11. On the other hand, the normalized bandwidth of the present invention which has a capacitor is 1.8 times as-large as that of a prior art as shown by the curve enclosed by the frame.

FIG. 12 shows the curves of the frequency characteristics of the phase difference error and the amplitude difference when the capacitance C of fixed to C=0.03 pF, where it is supposed that the phase velocity of even mode is higher than that of odd mode. In FIG. 12, the thin curves $a_1$ and $a_2$ show phase difference error and amplitude difference, respectively, of a prior art which has no capacitor, and the thick curves $b_1$ and $b_2$ show the phase difference error and amplitude difference, respectively, of the present invention which has a capacitor. It should be noted in FIG. 12 that the frequency characteristics of phase difference error ($b_1$) and amplitude difference ($b_2$) becomes small and is improved as compared with those ($a_1$ and $a_2$) of a prior art. Accordingly, it should be noted that the presence of a capacitor decreases the amplitude difference and phase difference error in the operation band, and thus, increases the operation bandwidth.

The length of the coupled lines may be shorter than quarter wavelength (center frequency of a balun circuit is set higher than desired value), in that case, no deterioration of operation frequency band of a balun circuit occurs, and no amplitude difference error and no phase difference error increases. Therefore, the length of coupled lines may be shortened, and a small sized balun circuit is obtained.

The third embodiment described shows a multi-layer three-dimensional MMIC structure. Some modifications are of course possible to those skilled in the art, for instance, a micro-strip type MMIC is possible instead of a three-dimensional MMIC, and/or an offset or curved coupled line in meander type or spiral type is possible instead of a linear type.

(Fourth Embodiment)

Figure 13:
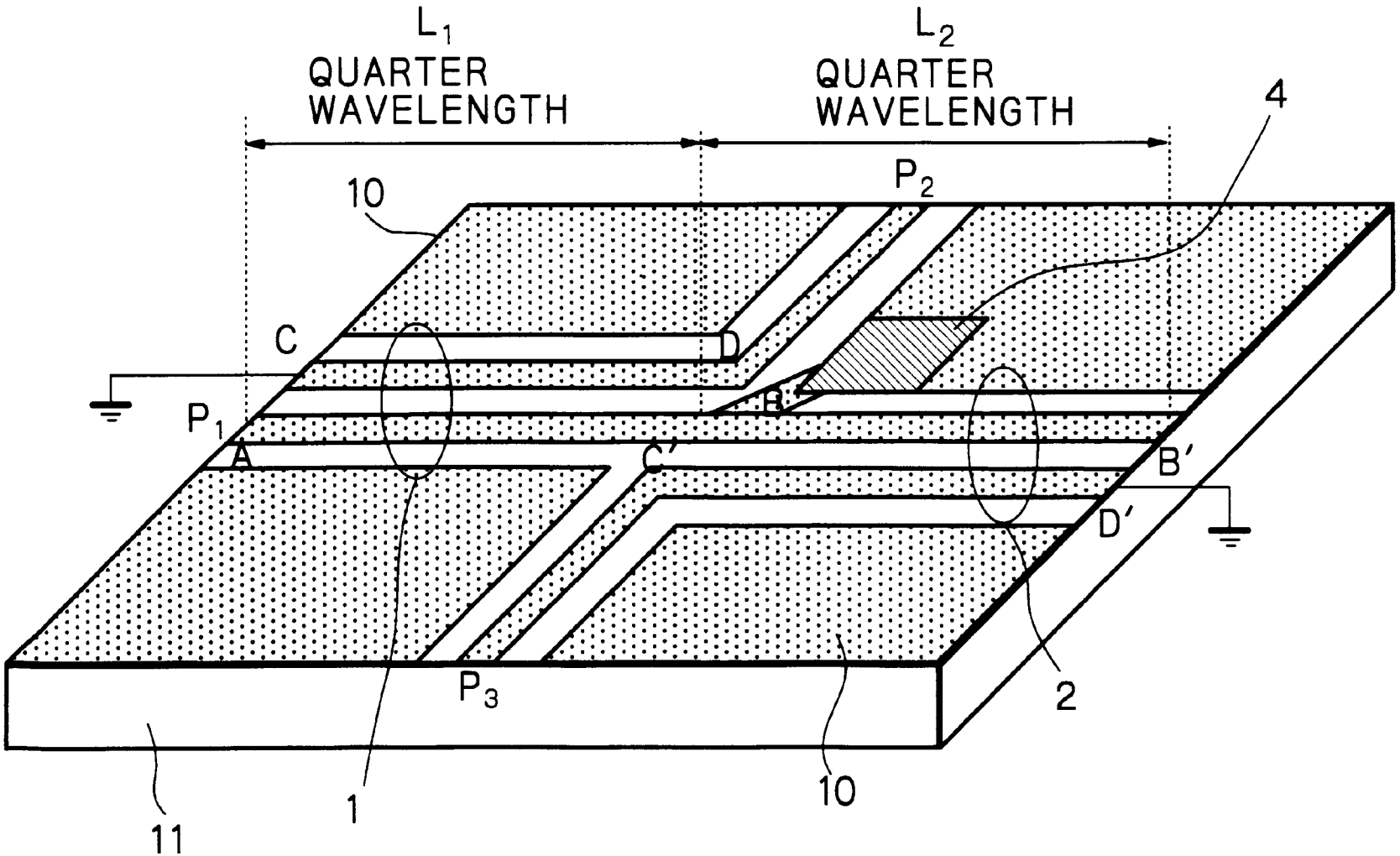
FIG. 13 shows an enlarged perspective view of still another embodiment of a balun circuit according to the present invention.

FIG. 13 shows a fourth embodiment of a balun circuit according to the present invention. The equivalent circuit of FIG. 13 is the same as FIG. 9. The feature of the embodiment of FIG. 13 is that a balun circuit is composed of a coplanar circuit, instead of a three-dimensional MMIC. In FIG. 13, the symbols A–D, A'–D', ports $P_1$–$P_3$ correspond to those in FIG. 9.

In FIG. 13, the numeral 11 is a semiconductor substrate, on which a ground conductor 10 is attached. A pair of lines composing a first coupled line 1, another pair of lines composing a second coupled line 2 are provided by slotting or removing a part of the ground conductor 10 so that those coupled lines 1 and 2 are parallel but are offset at the junction A'(=B). A capacitor 4 is provided in the substrate 11. The capacitor 4 has a pair of electrodes sandwiching a dielectric layer. The junction A'(=B) of two coupled lines is grounded to the ground conductor 10 through the capacitor 4.

The structure of FIG. 13 has the similar advantage to that of the embodiment of FIG. 9, and provides the improved amplitude difference and the improved phase difference error, and thus, increases the operation bandwidth. Further, even when the length of the coupled lines is shorter than quarter wavelength and the operation center frequency is higher than the desired center frequency, no deterioration of operation frequency band of a balun circuit occurs, and therefore, the length of coupled lines may be shortened, and a small sized balun circuit is obtained.

Of course, a meander or a spiral type coupled line is possible, instead of a linear line.

(Fifth Embodiment)

Figure 14:
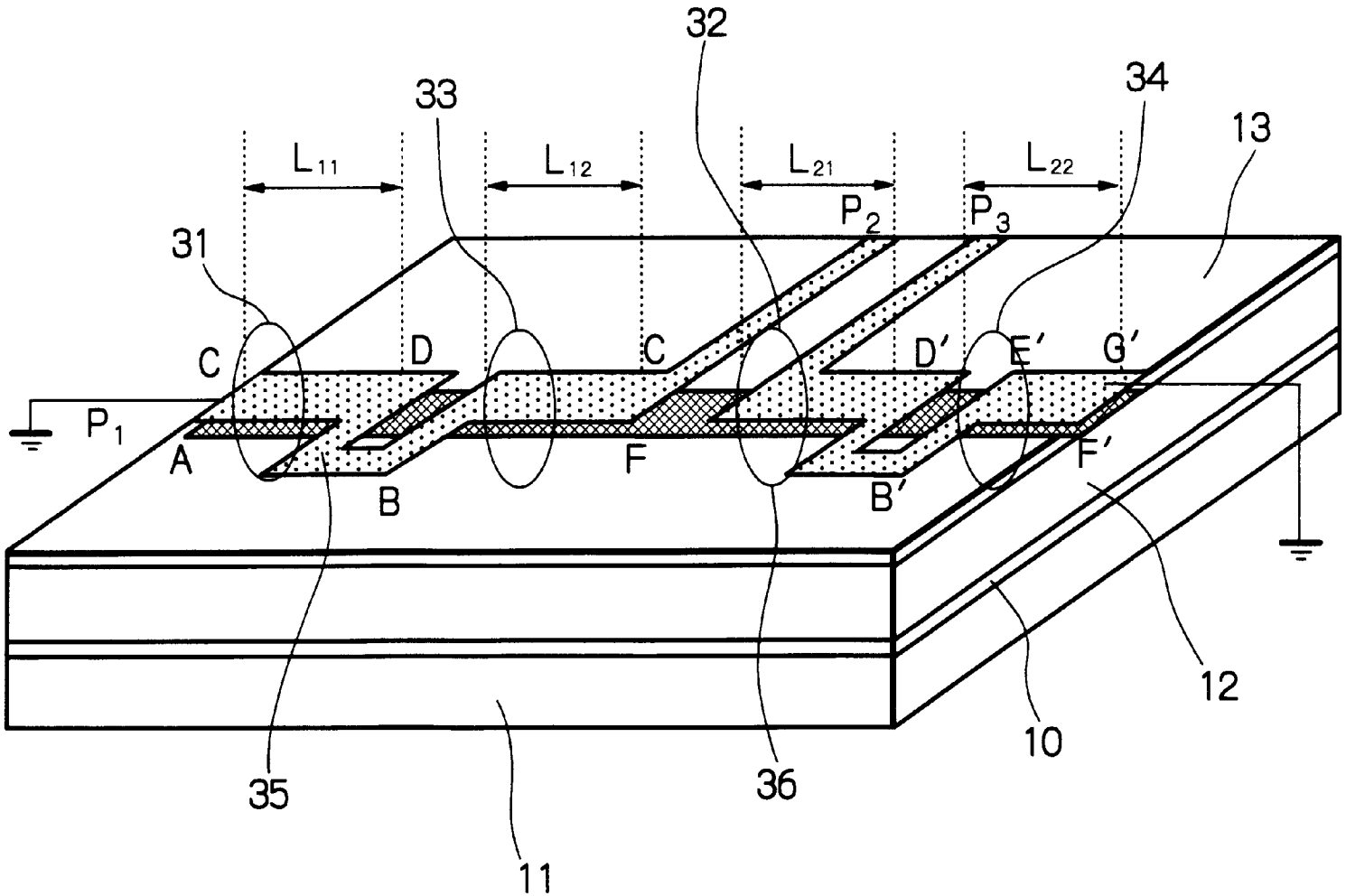
FIG. 14 shows an enlarged perspective view of still another embodiment of a balun circuit according to the present invention.
Figure 15:
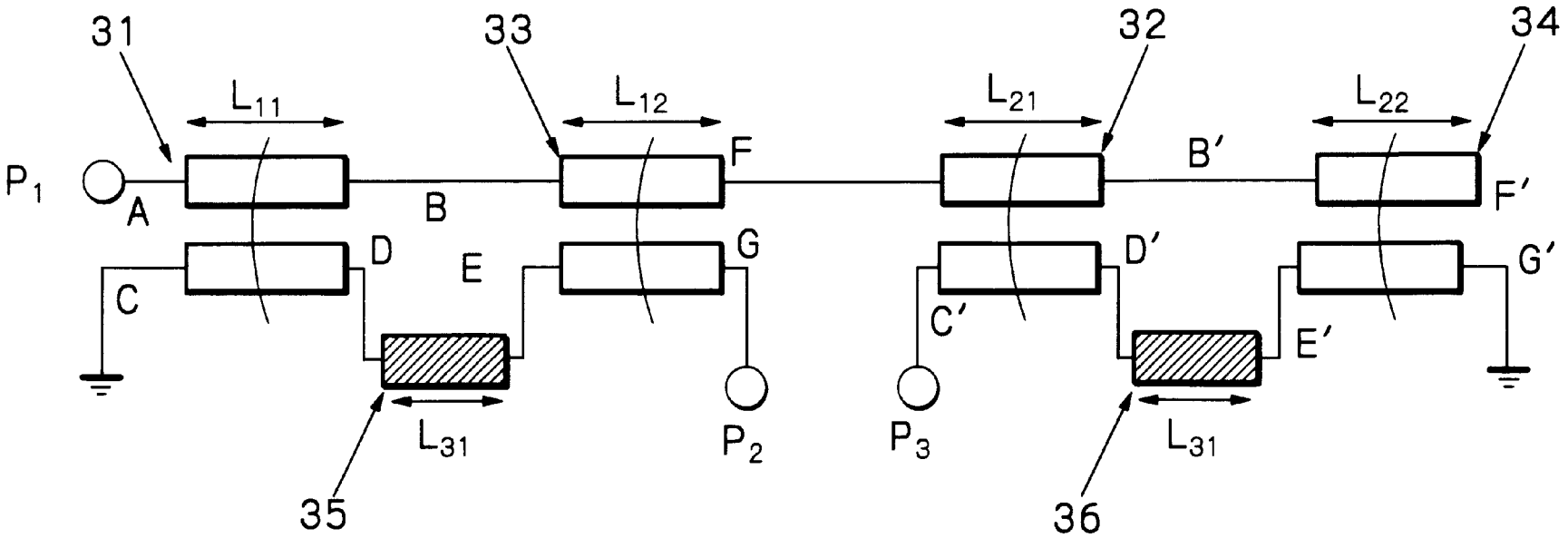
FIG. 15 is an equivalent circuit of a balun circuit of FIG. 14.

FIG. 14 shows an enlarged perspective view of fifth embodiment of a balun circuit according to the present invention, and FIG. 15 shows an equivalent circuit of FIG. 14. That embodiment concerns a balun circuit having three-dimensional MMIC structure. The symbols A–D, A'–D' and $P_1$–$P_3$ correspond to previous embodiments.

In FIGS. 14 and 15, the numeral 11 is a semiconductor substrate, on which a ground conductor 10 is attached. A first dielectric layer 12 is attached on the ground conductor 10. On the first dielectric layer 12, lower conductors of a first coupled line 31, a third coupled line 33, a second coupled line 32, a fourth coupled line 34 are provided. An input port $P_1$ is coupled with an extreme end A of the lower conductor of the first coupled line 31.

The symbol B shows a junction of the lower conductors of the first coupled line 31 and the third coupled line 33. The symbol B' shows a junction of the lower conductors of the second coupled line 32 and the fourth coupled line 34. The symbol F shows the junction of the lower conductors of the third coupled line 33 and the second coupled line 32.

The sum ($L_{11}$+$L_{12}$) of the length $L_{11}$ of the first coupled line 31 and the length $L_{12}$ of the third coupled line 33, and the sum ($L_{21}$+$L_{22}$) of the length $L_{21}$ of the second coupled line 32 and the length of the fourth coupled line $L_{34}$ are quarter wavelength. The junction F corresponds to the junction B or A' of FIG. 23.

A second dielectric layer 13 is attached on the first dielectric layer 12 which mounts the lower conductors. On the second dielectric layer 13, the upper conductor of the first coupled line 31, the first transmission line 35 of the length $L_{31}$, the upper conductor of the third coupled line 33, the upper conductor of the second coupled line 32, the second transmission line 36 of the length $L_{31}$ and the upper conductor of the fourth coupled line 34 are deposited. One end G of the third coupled line 33 is coupled with the output port $P_2$ through the lead conductor deposited on the second dielectric layer 13, and one end C' of the second coupled line 32 is coupled with the output port $P_3$ through the lead conductor deposited on the second dielectric layer 13. One end C of the upper conductor of the first coupled line 31, and one end G' of the upper conductor of the fourth coupled line 34 are grounded.

The symbol D is a junction of the upper conductor of the first coupled line 31 and one end of the first transmission line 35, and the symbol E is a junction of the other end of the first transmission line 35 and the upper conductor of the third coupled line 33. The symbol D' is a junction of the upper conductor of the second coupled line 32 and one end of the second transmission line 36, and the symbol E' is a junction of the other end of the second transmission line 36 and the fourth coupled line 34.

It should be noted that the fifth embodiment in FIGS. 14 and 15 has the feature that the transmission lines 35 and 36 which are not a part of a coupled line are inserted in coupled lines between the coupling ends (G, C') which are coupled with the output ports ($P_2$, $P_3$), and the isolation ends (C, G') which are grounded.

Figure 16A:
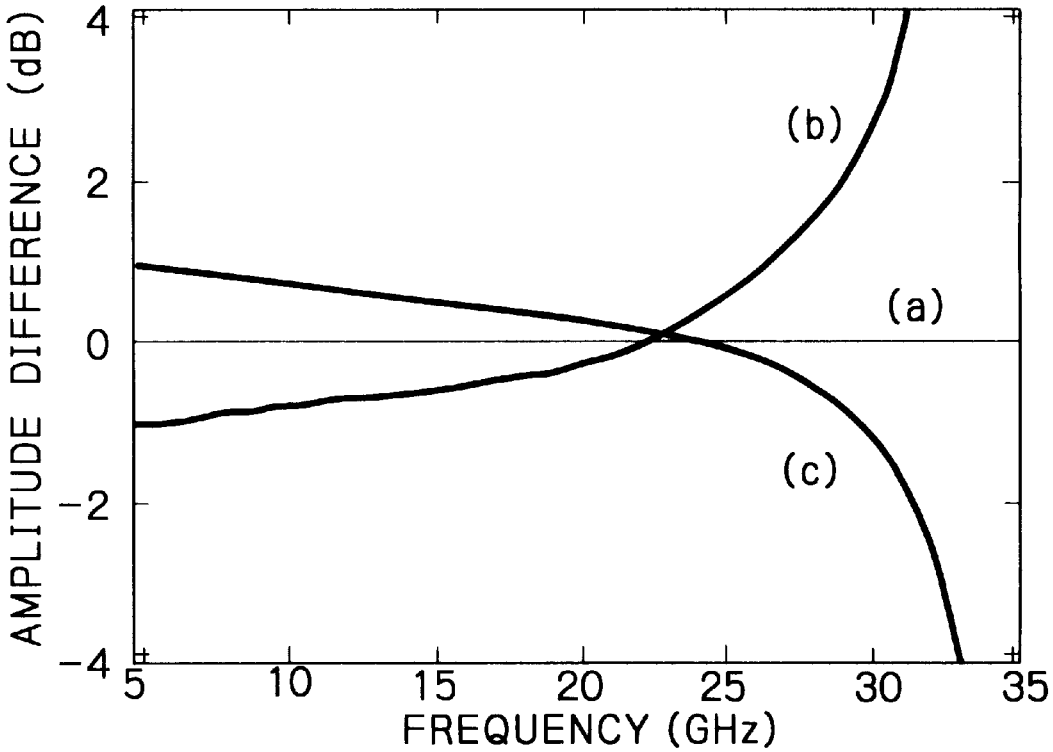
FIG. 16(A) shows calculated amplitude characteristics and FIG. 16(B) shows calculated phase characteristics.
Figure 16B:
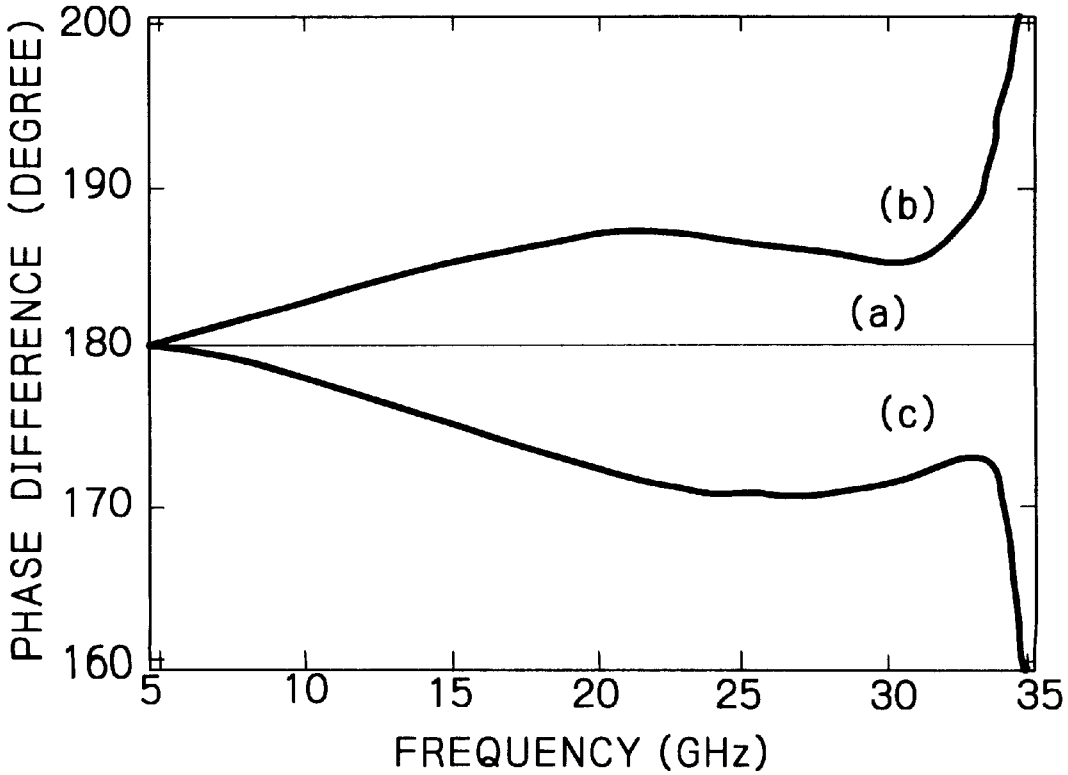

FIG. 16 shows curves for explanation of operation principle of the balun circuit of FIGS. 14 and 15. FIG. 16(A) shows calculated amplitude characteristics, and FIG. 16(B) shows calculated phase characteristics. In those drawings, the curve (a) shows an ideal case when no phase velocity difference between even- and odd-modes exist, the curve (b) shows a case when there exists phase velocity difference between even- and odd-modes, and the curve (c) shows a case when transmission lines 35 and 36 are inserted in the ideal balun circuit of the curve (a).

The parameters in FIG. 16 are as follows.

Coupled line;

Characteristic impedance of even mode; $Z_e$=121Ω

Characteristic impedance of odd mode; $Z_o$=21Ω

Length $L_1$(=$L_{11}$+$L_{12}$=$L_{21}$+$L_{22}$); $L_1$=1.987 mm

Curve (a);

Effective dielectric constant of even mode; $\epsilon_e$=3.04

Effective dielectric constant of odd mode; $\epsilon_o$=3.04

Curve (b);

Effective dielectric constant of even mode; $\epsilon_e$=4.22

Effective dielectric constant of odd mode; $\epsilon_o$=3.04

Curve (c);

Effective dielectric constant of even mode; $\epsilon_e$=3.04

Effective dielectric constant of odd mode; $\epsilon_o$=3.04

Length $L_{31}$ of inserted transmission line; $L_{31}$=0.33 mm

It should be appreciated in FIG. 16 that the curve (b) where there exists phase velocity difference is opposite to the curve (c) where transmission lines are coupled with a balun circuit, and the curves (b) and (c) are symmetrical relating to the ideal curve (a). Therefore, the amplitude error and the phase difference error of a balun circuit is compensated by attaching transmission lines 35 and 36 between coupled lines, although characteristic impedance of even mode and loss of coupled lines are the same as those of a prior art.

Figure 17:
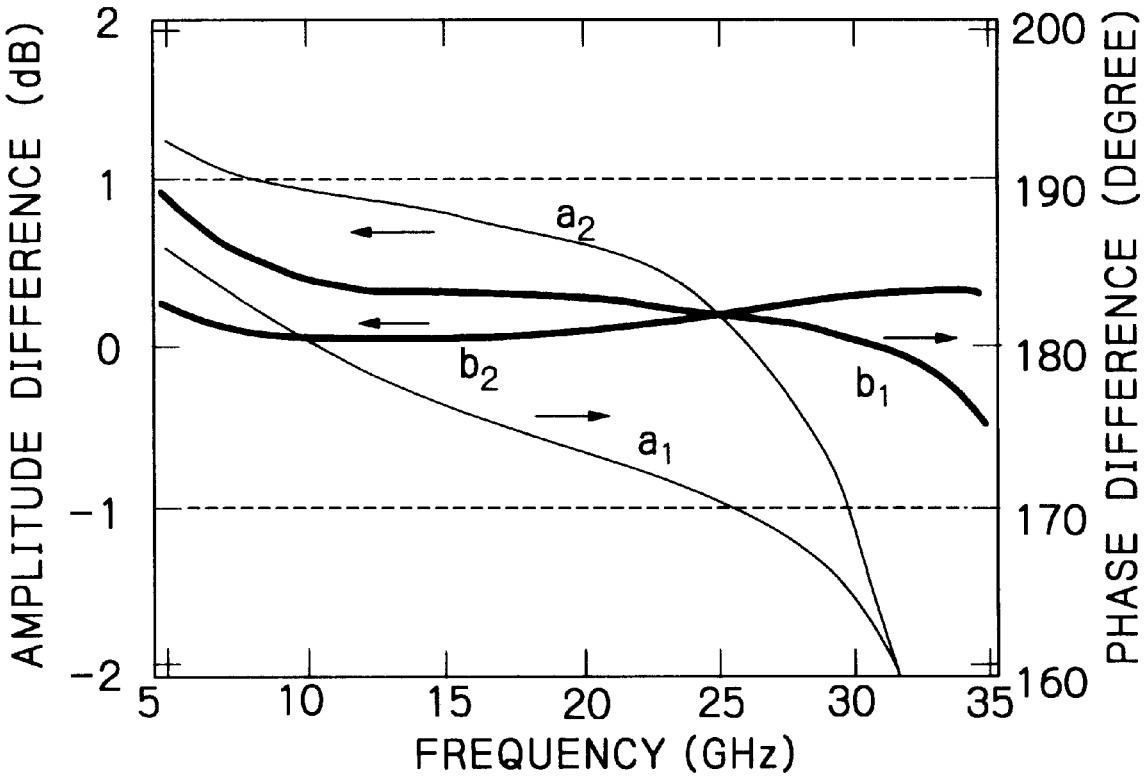
FIG. 17 shows frequency characteristics of amplitude difference and phase difference error when the length of the transmission line in FIG. 15 is fixed.

The operation of the balun circuit of FIGS. 14 and 15 is now described in accordance with FIG. 17.

FIG. 17 shows the curves of the frequency characteristics of the phase difference error and the amplitude difference when the length $L_{31}$ of the transmission line is $L_{31}$=0.33 mm, and the length (=$L_{11}$+$L_{12}$=$L_{21}$+$L_{22}$) of the coupled line is 0.75×(quarter wavelength). The thick lines $b_1$ and $b_2$ show the characteristics of the present invention, and the thin lines $a_1$ and $a_2$ shows the characteristics of a prior art.

It is supposed that the phase velocity of even mode is smaller than that of odd mode. As shown in FIG. 17, the amplitude error and the phase difference error are reduced by the present invention. Further, as the length of the coupled line is shorter than quarter wavelength, a coupled line or a balun circuit itself is small in size.

Although the fifth embodiment shows a circuit produced on an MMIC structure, it is possible to produce a circuit by using a micro-strip line structure. Further, the use of a meander line or a spiral line instead of a linear line is useful for reducing size of a circuit.

(Sixth Embodiment)

Figure 18:
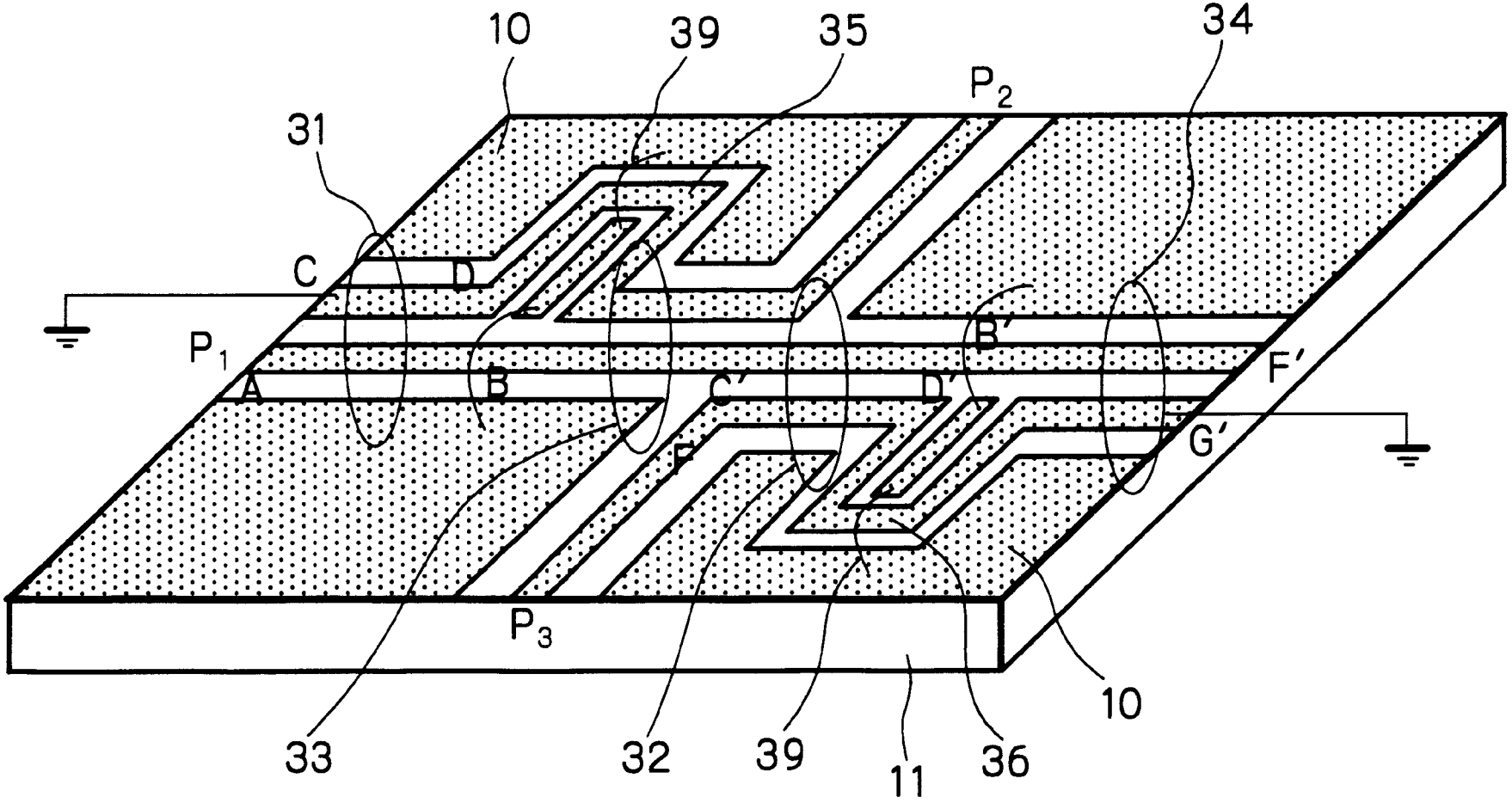
FIG. 18 is an enlarged perspective view of still another embodiment of a balun circuit according to the present invention.

FIG. 18 shows an enlarged view of sixth embodiment of a balun circuit according to the present invention. The equivalent circuit of FIG. 18 is the same as FIG. 15. The feature of the embodiment of FIG. 18 is that a balun circuit is produced by using a coplanar circuit. In FIG. 18, the symbols A–D, A'–D', and the ports $P_1$–$P_3$ correspond to those in FIG. 15.

In FIG. 18, the numeral 11 is a semiconductor substrate on which a ground conductor 10 is attached. A first coupled line 31, a third coupled line 33, a second coupled line 32, a fourth coupled line 34, a first transmission line 35 and a second transmission line 36 are provided as shown in the figure by slotting or removing a part of the ground conductor. An island surrounded by a transmission line operates as a part of a ground conductor and is coupled with the ground conductor 10 through an air bridge 39.

The embodiment of FIG. 18 has the similar advantage to that of the previous embodiments. A coupled line may be in meander or spiral instead of linear line for further reduction of size.

(Seventh Embodiment)

Figure 19:
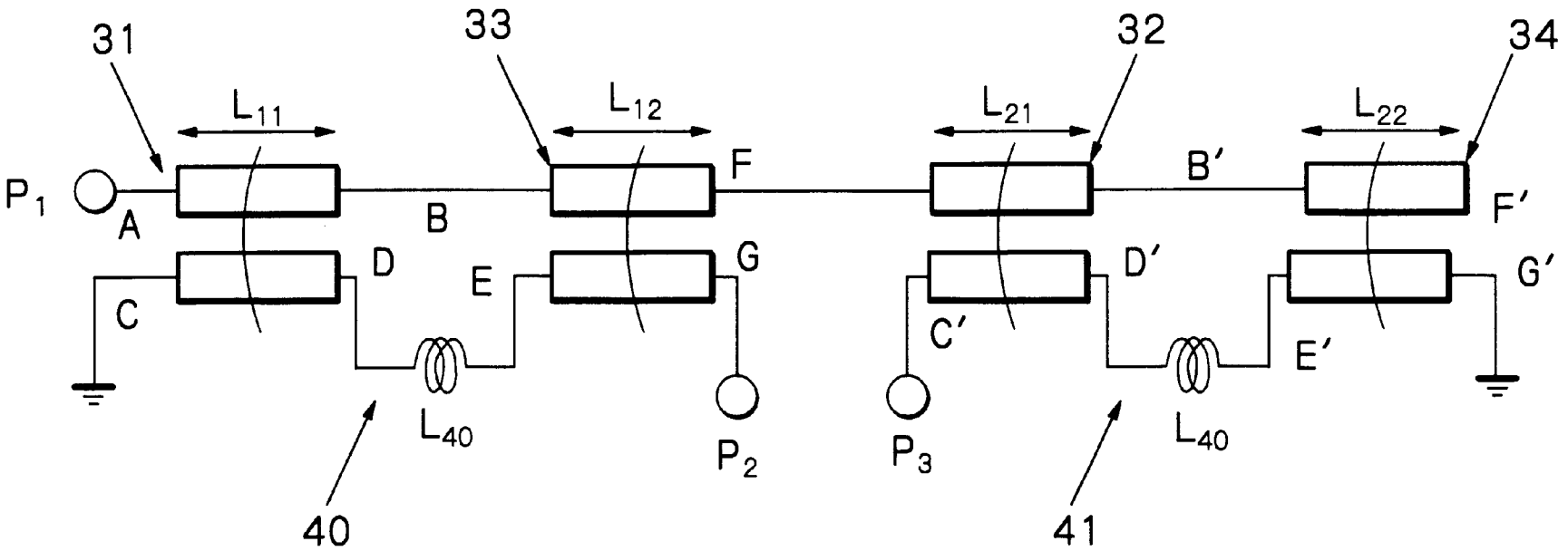
FIG. 19 is an equivalent circuit of a balun circuit of FIG. 18.

FIG. 19 shows an equivalent circuit of seventh embodiment of a balun circuit according to the present invention. The feature of FIG. 19 is that the transmission lines 35 and 36 in FIG. 15 are replaced by the inductors 40 and 41, respectively, in FIG. 19.

Figure 20A:
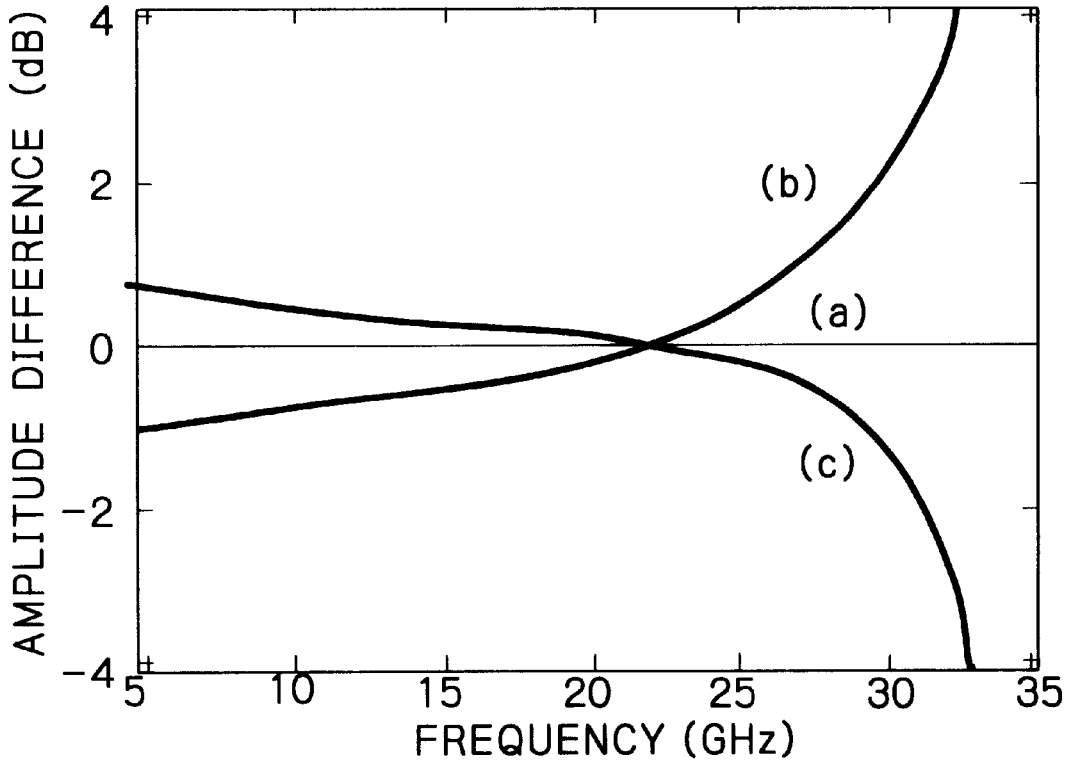
FIG. 20(A) shows calculated amplitude characteristics.
Figure 20B:
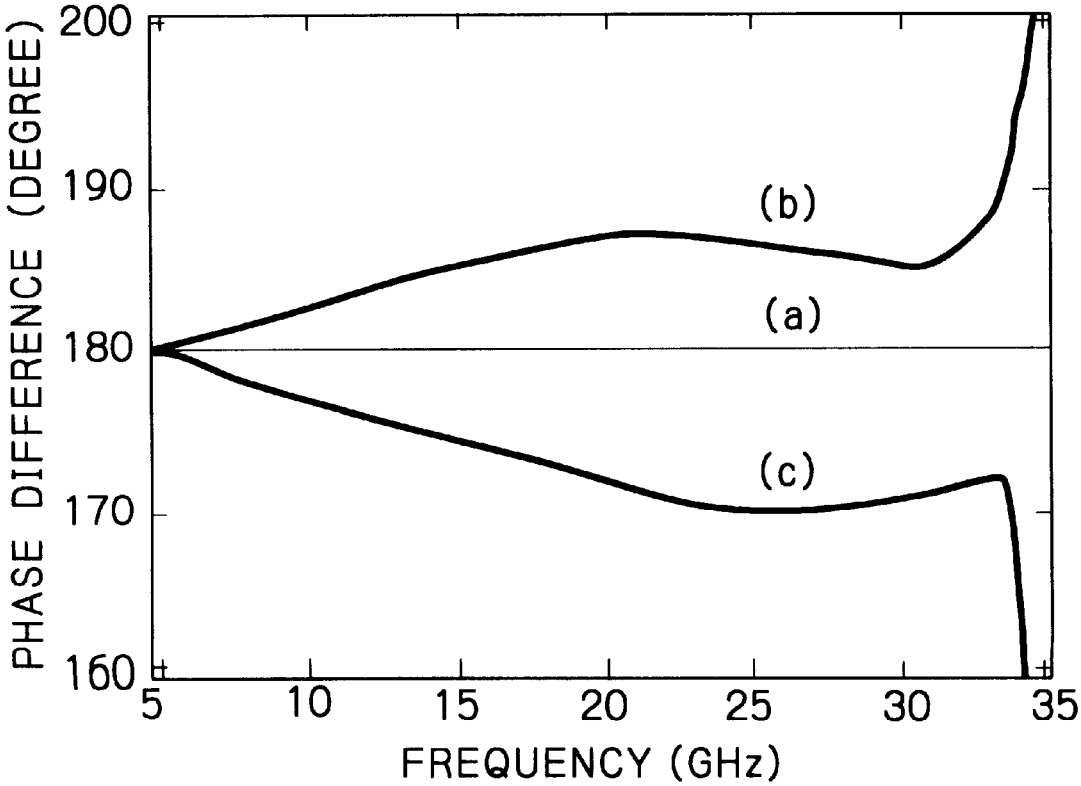
FIG. 20(B) shows calculated phase characteristics.

FIG. 20 shows curves for explanation of operation principle of the balun circuit of FIG. 19. FIG. 20(A) shows calculated amplitude characteristics of a balun circuit, and FIG. 20(B) shows calculated phase characteristics of a balun circuit. In those drawings, the curve (a) shows an ideal case when no phase velocity difference between even- and odd-modes exist in a balun circuit, the curve (b) shows a case when there exists phase velocity difference between even- and odd-modes, and the curve (c) shows a case when inductors 40 and 41 are inserted in the ideal balun circuit of the curve (a).

The parameters in FIG. 20 are as follows.

Coupled line;

Characteristic impedance of even mode; Ze=121Ω

Characteristic impedance of odd mode; $Z_o$=21Ω

Length $L_1$ of a coupled line; $L_1$=1.987 mm

Curve (a);

Effective dielectric constant of even mode; $\epsilon_e$=3.04

Effective dielectric constant of odd mode; $\epsilon_o$=3.04

Curve (b);

Effective dielectric constant of even mode; $\epsilon_e$=4.22

Effective dielectric constant of odd mode; $\epsilon_o$=3.04

Curve (c);

Effective dielectric constant of even mode; $\epsilon_e$=3.04

Effective dielectric constant of odd mode; $\epsilon_o$=3.04

Inductance of inductors 40, 41; L=0.11 nH

It should be appreciated in FIG. 20 that the curve (b) where there exists phase velocity difference is opposite to the curve (c) where inductors are coupled with coupled lines, and those curves (b) and (c) are symmetrical relating to the ideal curve (a). Therefore, the amplitude error and the phase difference error of a balun circuit is compensated by attaching inductors, although characteristic impedance of even mode and loss of a balun circuit are the same as those of a prior art.

Figure 21:
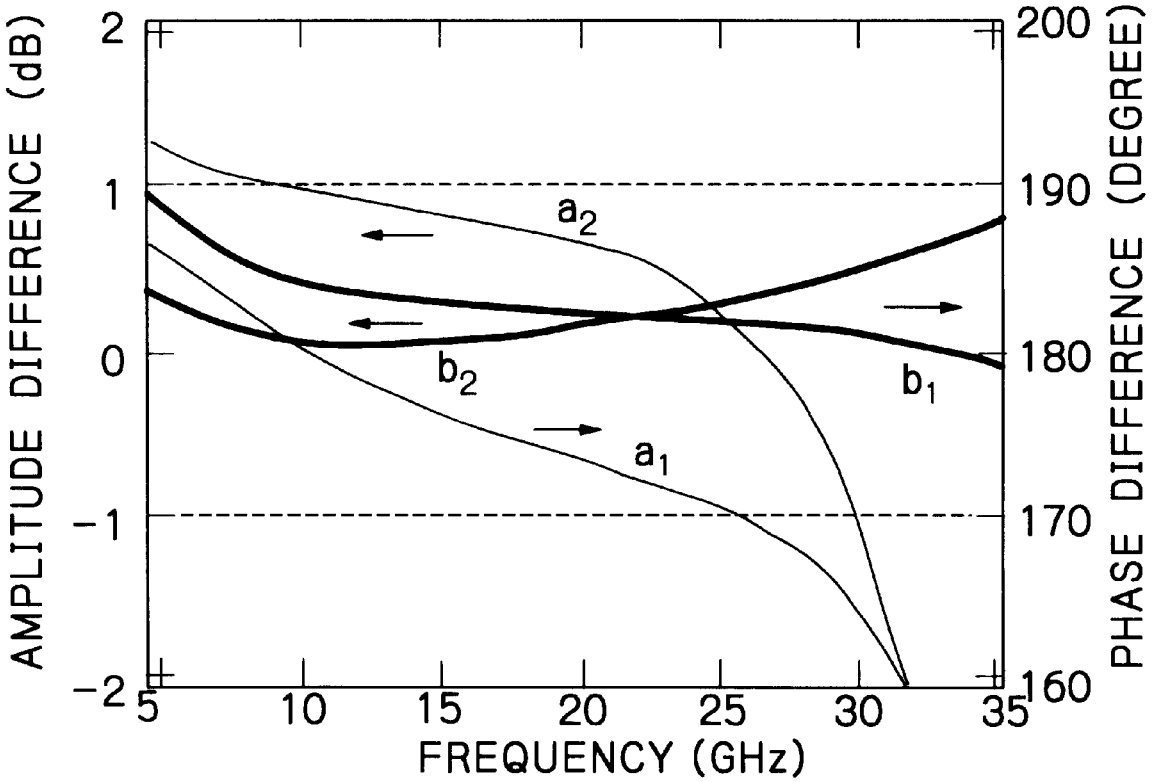
FIG. 21 shows frequency characteristics of amplitude difference and phase difference error of a balun circuit of FIG. 18 in which the inserted inductance is fixed.

The operation of the balun circuit of FIG. 19 is now described in accordance with FIG. 21.

FIG. 21 shows the curves of the frequency characteristics of the phase difference error and the amplitude difference when the inductance of the inductors 40 and 41 is $L_{40}$=$L_{41}$=0.11 nH, and the length of the coupled lines is 0.75×(quarter wavelength). The thick lines $b_1$ and $b_2$ show the characteristics of the seventh embodiment, and the thin lines $a_1$ and $a_2$ show the characteristics of a prior art which has no inductors.

In FIG. 21, it is supposed that the phase velocity of even mode is smaller than the phase velocity of odd mode. It should be noted in FIG. 21, that the error of amplitude error and the phase difference error in output signal in the present invention is reduced as compared with those in a prior art. Further, it should be noted that FIG. 21 shows the case that the length of coupled lines is shorter than a quarter wavelength.

Thus, it should be appreciated that seventh embodiment of FIG. 19 reduces amplitude error and phase difference error of output signal, and, increases operation bandwidth.

Further, it should be noted that as the length of coupled lines is shorter than a quarter wavelength, a balun circuit may be small in size.

FIG. 19 shows only an equivalent circuit. It may be implemented either by using three-dimensional MMIC structure, or a micro-strip type MMIC. Further, a coplanar line is possible. Further, a meander line and/or a spiral line instead of a linear line may be possible for further reduction of size.

(Eighth Embodiment)

Figure 22:
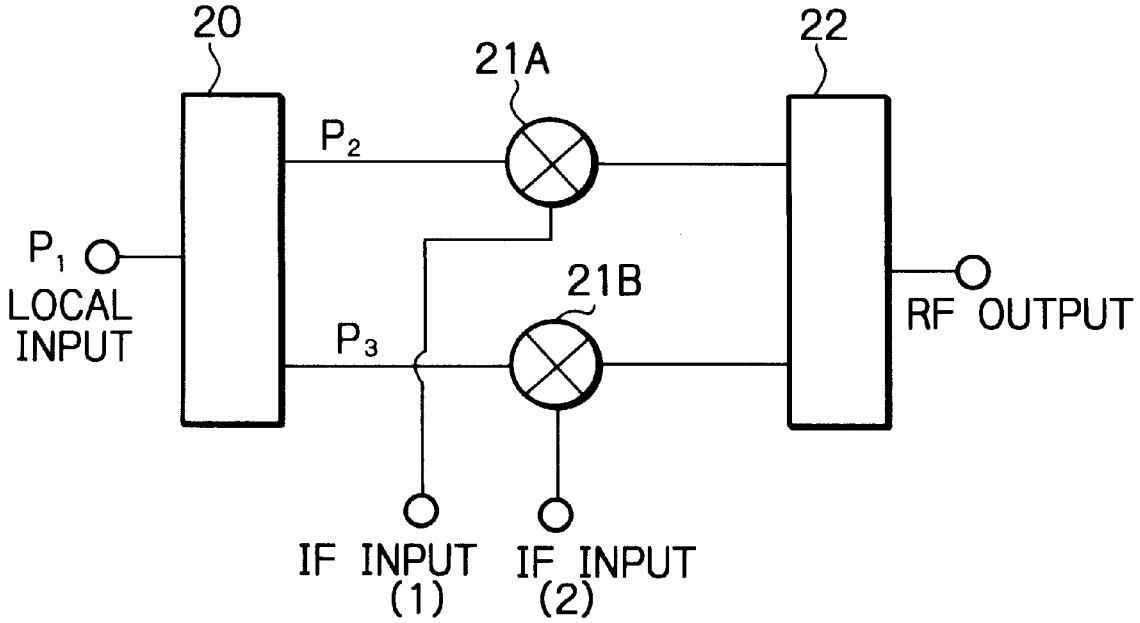
FIG. 22 shows a block diagram of a balanced frequency mixer which uses the balun circuit according to the present invention.

FIG. 22 shows a block diagram of a balanced frequency mixer which uses a balun circuit which may be anyone of the embodiments of the present invention.

In FIG. 22, the numeral 20 is a balun circuit which may be anyone of the embodiments of the present invention, 21A and 21B are a frequency mixer, and 22 is a Wilkinson divider. The balun circuit 20 has an input port $P_1$ which receives a local frequency, and provides a pair of outputs which have the same amplitude as each other and opposite phase to the other to the output ports $P_2$ and $P_3$. Each of the frequency mixers 21A and 21B receives the related local frequency and IF signal (intermediate frequency signal) so that the IF signal is frequency-converted to radio frequency. The outputs of the frequency mixers 21A and 21B are applied to the Wilkinson divider 22, which combines the outputs of the pair of frequency mixers 21A and 21B with in-phase condition, and provides radio frequency signal to a RF output.

Because of the use of a pair of local frequencies having the same amplitude and opposite phase, no leakage of local frequency is found in frequency converted RF signal. The frequency mixer of FIG. 22 may be implemented on anyone of three-dimensional MMIC, micro-strip line MMIC circuit, and coplanar MMIC circuit. It should be appreciated that the use of the present balun circuit allows the decrease of leakage of local frequency, small size of an apparatus, and wideband of operation frequency, as compared with a prior art.

As described in detail, the present balun circuit which is implemented on a semiconductor substrate made of GaAs or Si, and has a transmission line, a capacitor, or an inductor, in coupled lines has the advantage that the amplitude error and the phase difference error between two outputs are decreased as compared with those of a prior art, although characteristic impedance of even mode and loss are the same as a prior art.

Further, it should be appreciated that phase difference between two outputs of a balun circuit may be finely adjusted by adjusting transmission line, capacitance, or inductance which is inserted in coupled lines, and thus, the phase balance is kept in wideband. Further, as the present invention is simple in structure, no interdigital structure of a coupled line is necessary, and the thickness of a substrate is thin, the size of the present balun cirucit is small.

From the foregoing, it will now be apparent that a new and improved balun circuit has been found. It should be understood of course that the embodiments disclosed are merely illustrative and are not intended to limit the scope of the invention. Reference should be made to the appended claims, therefore, for indicating the scope of the invention.

What is claimed is:

1. A balun circuit having an input port and a pair of output ports which provide output signals having the same amplitude and opposite phase to each other relating to an input signal input into said input port, comprising:

a first coupled line and a second coupled line each equal to or shorter than a quarter wavelength, and each having an input port, a through port, a coupled port and an isolation port, each defined in accordance with a reference port;

a reference port of the first coupled line and a reference port of the second coupled line being coupled, an isolation port of the first coupled line being grounded, and an isolation port of the second coupled line being grounded;

a through port of the second coupled line being open;

a through port of the first coupled line being an input port of the balun circuit;

coupling ports of the first and second coupled lines respectively being output ports of the balun circuit;

a cancellation element being coupled with each coupled line for compensating amplitude difference and phase difference error of output signals on said output ports;

wherein said cancellation element comprises a transmission line inserted in one of the lines of each coupled line between ground and an output port.

2. A balun circuit having an input port and a pair of output ports which provide output signals having the same amplitude and opposite phase to each other relating to an input signal input into said input port, comprising:

a first coupled line and a second coupled line each equal to or shorter than a quarter wavelength, and each having an input port, a through port, a coupled port and an isolation port, each defined in accordance with a reference port;

a reference port of the first coupled line and a reference port of the second coupled line being coupled, an isolation port of the first coupled line being grounded, and an isolation port of the second coupled line being grounded;

a through port of the second coupled line being open;

a through port of the first coupled line being an input port of the balun circuit;

coupling ports of the first and the second coupled lines respectively being output ports of the balun circuit;

a cancellation element being coupled with each coupled line for compensating amplitude difference and phase difference error of output signals on said output ports;

wherein said cancellation element comprises an inductor inserted in one of the lines of each coupled line between ground and an output port in each coupled line.

3. A balun circuit according to claims 1 or 2 further comprising a balanced frequency mixer comprising a divider for dividing a local frequency into a pair of the same amplitude and opposite phase signals, frequency conversion means for converting an IF signal to radio frequency by using outputs of said divider, and a signal combiner for combining outputs of said frequency conversion means.

4. A balun circuit according to claims 1 or 2 wherein each of said coupled lines is produced on multi-layered dielectric layers.

5. A balun circuit according to claim 1, wherein length of said coupled lines is in the range between a quarter wavelength and 0.65×(a quarter wavelength).

* * * * *